US012116722B2

(12) United States Patent
Chae et al.

(10) Patent No.: US 12,116,722 B2
(45) Date of Patent: Oct. 15, 2024

(54) CLOTHES FOLDING MACHINE

(71) Applicant: LG Electronics Inc., Seoul (KR)

(72) Inventors: Aekyung Chae, Seoul (KR); Keunjoo Kim, Seoul (KR); Chanwoo Moon, Seoul (KR); Choongho Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 374 days.

(21) Appl. No.: 17/624,699

(22) PCT Filed: Mar. 23, 2020

(86) PCT No.: PCT/KR2020/003962

§ 371 (c)(1),
(2) Date: Jan. 4, 2022

(87) PCT Pub. No.: WO2021/002566

PCT Pub. Date: Jan. 7, 2021

(65) Prior Publication Data

US 2022/0251776 A1 Aug. 11, 2022

(30) Foreign Application Priority Data

Jul. 4, 2019 (KR) ..... 10-2019-0080906

(51) Int. Cl.
*D06F 89/02* (2006.01)

(52) U.S. Cl.
CPC ..... *D06F 89/023* (2013.01)

(58) Field of Classification Search
CPC ..... D06F 89/00; D06F 89/02; D06F 89/023; A41H 43/0257; B65G 65/02
USPC ..... 223/37
See application file for complete search history.

(56) References Cited

U.S. PATENT DOCUMENTS

| | | | | |
|---|---|---|---|---|
| 3,361,424 | A * | 1/1968 | Kamberg | D06F 89/00 493/418 |
| 2019/0309465 | A1* | 10/2019 | Rozov | A41H 43/0257 |
| 2020/0248397 | A1* | 8/2020 | Nitschmann | B65H 29/16 |
| 2020/0385918 | A1* | 12/2020 | Naor | D06F 89/00 |

FOREIGN PATENT DOCUMENTS

| | | |
|---|---|---|
| JP | 05068798 | 3/1993 |
| JP | 2004159726 | 6/2004 |
| JP | 2013252295 | 12/2013 |
| WO | WO2019038752 | 2/2019 |
| WO | WO2019043712 | 3/2019 |

* cited by examiner

*Primary Examiner* — Nathan E Durham
(74) *Attorney, Agent, or Firm* — Fish & Richardson P.C.

(57) ABSTRACT

Proposed is a clothes folding machine, which includes a case, a loading unit disposed at an upper portion of the case, having a plurality of grippers, and conveying a clothes item gripped by the grippers into the case, a folding unit including a longitudinal-line folder folding both sleeves of the clothes item along longitudinal line to overlap and a transverse-line folder configured to fold the clothes item along a transverse line to overlap, and an unloading unit disposed at a lower portion of the case and conveying the clothes item folded by the folding unit outside the case.

16 Claims, 14 Drawing Sheets

CLOTHES FOLDING MACHINE

CROSS-REFERENCE TO RELATED APPLICATIONS

This application is a National Stage application under 35 U.S.C. § 371 of International Application No. PCT/KR2020/003962, filed on Mar. 23, 2020, which claims the benefit of Korean Application No. 10-2019-0080906, filed on Jul. 4, 2019. The disclosures of the prior applications are incorporated by reference in their entirety.

TECHNICAL FIELD

The present disclosure relates to a clothes folding machine that longitudinally and transversely folds clothes.

BACKGROUND ART

In general, a clothes folding machine is a machine that automatically folds clothes that have been washed and dried.

A clothes folding machine may be divided into a loading unit, a folding unit, and an unloading unit.

When a user hangs a clothes item on the loading unit, the loading unit holds and conveys the clothes item to the folding unit.

The folding unit performs longitudinal-line folding or transverse-line folding on the conveyed item of clothes.

The unloading unit discharges the folded clothes item out of the clothes folding machine.

Clothes discharged through the unfolding unit may be neatly stacked in predetermined shapes on a shelf and exposed to customers in a clothes store, etc., or may be stored in a drawer, etc. by customers at home, etc.

Clothes folding machines of the related art may be classified into a conveyer type, a bar type, a plate type, etc., depending on the folding method and conveying method.

A conveyer-type clothes folding machine moves clothes in the space between conveyers and folds the clothes therein.

A plate-type clothes folding machine folds clothes using two side plates having a height difference from a middle plate.

A bar-type clothes folding machine supports a clothes item with one bar and folds the clothes item with a moving bar.

The conveyer-type, bar-type, and plate-type clothes folding machines are each divided into and composed of a loading unit, a folding unit, and an unloading unit.

A conveyer-type clothes folding machine has been disclosed in a prior patent document WO 2018/122841 A1 (Pub. Date: Jul. 5, 2018) in relation to the present disclosure.

The clothes folding machine of the prior patent is configured to perform primary longitudinal-line folding simultaneously with loading of clothes to efficiently use a space and reduce the size of the folding machine.

However, according to the clothes folding machine of the prior patent document, loading, folding, and unloading are separately performed on different stages of a total of seven stacked conveyers, and particularly, longitudinal-line folding and transverse-line folding should be performed at least two times or more on different stages. Accordingly, there is a problem that the number of stacked conveyers is increased, so the height or size of the folding machine is increased.

In particular, according to the prior patent, a clothes item passes a fixed first folder (hereafter, a longitudinal-line folder) simultaneously with loading in primary longitudinal-line folding, and in this process, the longitudinal-line folder passively primarily folds the sleeves of the clothes item.

However, since the longitudinal-line folder that is used for primary longitudinal-line folding of sleeves is fixed, there is a problem that the longitudinal-line folder cannot be moved in the width direction in accordance with the kinds or sizes of clothes.

For example, when a top is too large and the shoulder width is excessively large (XXL), both sleeves are not transversely fully folded or are wrinkled due to interference therebetween when passing the longitudinal-line folder.

DISCLOSURE

Technical Problem

The present disclosure has been made in an effort to solve the problems of the related art and a first objective of the present disclosure is to provide a clothes folding machine of which an unnecessary height can be reduced and that can be manufactured in a compact size by loading and longitudinally folding clothes on one stage at a time.

A second objective of the present disclosure is to provide a clothes folding machine that can perform longitudinal-line folding on various clothes having various sizes because sub-boards are configured in an active type to be able to move in the transverse direction of clothes.

Technical Solution

In order to achieve the first objective, a clothes folding machine according to the present disclosure includes a longitudinal-line folder for folding both sleeves of a clothes item at the same single stage together with a loading unit and the sleeves are folded simultaneously with loading of the clothes item, so it is possible to decrease an unnecessary height of the clothes folding machine and minimize the size of the clothes folding machine.

In order to achieve the second objective, since a plurality of sub-boards is installed at both sides under a main board to be able to transversely move in accordance with the kinds and sizes of clothes, it is possible to fold even clothes having various kinds and sizes along longitudinal lines.

A clothes folding machine according to the present disclosure includes: a case; a loading unit disposed at an upper portion of the case, having a plurality of grippers, and conveying a clothes item gripped by the grippers into the case; a folding unit including a longitudinal-line folder folding both sleeves of the clothes item along longitudinal line to overlap and a transverse-line folder configured to fold the clothes item along a transverse line to overlap; and an unloading unit disposed at a lower portion of the case and conveying the clothes item folded by the folding unit outside the case, in which the longitudinal-line folder is disposed at a same single stage together with the loading unit, and the longitudinal-line folder includes: a main board supporting a body part of the clothes item conveyed by the loading unit such that the body part can slide; and a plurality of sub-boards installed to be able to transversely move with respect to the main board and folding the sleeves along the longitudinal lines, respectively, by transversely pushing the sleeves simultaneously with conveying by the loading unit.

According to an example related to the present disclosure, the sub-boards may be spaced apart from each other with different height differences under the main board.

According to an example related to the present disclosure, the sub-boards each may include: an entry guide formed such that a width gradually increases toward a downstream side from an upstream side of a path of the clothes item; and a fold maintainer formed with a constant width from the entry guide.

According to an example related to the present disclosure, the sub-boards may be mounted on top surfaces of a plurality of fixed plates, respectively, to be able to transversely move, and the fixed plates may be spaced apart from each other with different height differences under the main board.

According to an example related to the present disclosure, the sub-boards may be smaller in size than the fixed plates, and front ends of the fixed plates may protrude toward a front of the case further than front ends of the sub-boards.

According to an example related to the present disclosure, front guides, which are inclined downward toward the front and to which the clothes item is loaded, may be formed at the front ends of the fixed plates, respectively, and may lift the sleeves hanging down from the main board.

According to an example related to the present disclosure, a plurality of guide protrusions guiding straight movement may be formed on a bottom surface of each of the sub-boards, and a plurality of guide grooves may be formed at the fixed plates to be able to be coupled to the guide protrusions.

According to an example related to the present disclosure, the clothes folding machine may further include: a driving motor driving each of the sub-boards such that the sub-boards can transversely straightly move; a screw connected with the driving motor to rotate; and a sliding member connected to a side edge of each of the sub-boards, having a nut portion coupled to the screw therein, and mounted to be able to slide along the screw.

According to an example related to the present disclosure, the clothes folding machine may further include: a driving motor driving each of the sub-boards such that the sub-boards can transversely straightly move; a ball screw connected with the driving motor to rotate; and a slider thread-fastened to the ball screw at an inner side thereof and transversely sliding along the ball screw.

According to an example related to the present disclosure, the clothes folding machine may further include: a driving motor driving each of the sub-boards such that the sub-boards can transversely straightly move; a pinion gear connected with the driving motor through a shaft to rotate; a rack gear engaged with the pinion gear and converting rotational motion of the driving motor into straight motion; and a support rotatably supporting the shaft and connected to each of the sub-boards.

According to an example related to the present disclosure, the sub-boards may be rotatably mounted on top surfaces of the fixing plates, respectively, and may be rotated between a first position where the sub-boards open in parallel toward an upstream side of a path of the clothes item and a second position where the sub-boards transversely close, and the fixed plates may be spaced apart from each other with different height differences under the main board.

According to an example related to the present disclosure, the clothes folding machine may further include: a driving motor driving each of the sub-boards such that the sub-boards can be transversely rotated; and a rotary shaft of which a first side is connected with the driving motor and a second side is coupled to a corner of each of the sub-boards to rotate each of the sub-boards.

According to an example related to the present disclosure, the sub-boards may be disposed to protrude toward an upstream side of a path of the clothes item further than the fixed plates.

According to an example related to the present disclosure, a protrusion may be formed on a transverse outer side of each of the sub-boards, and the protrusion may protrude in a curved shape toward the upstream side of a path of the clothes item from a side of each of the sub-boards.

A clothes folding machine according to another embodiment of the present disclosure includes: a case; a loading unit disposed at an upper portion of the case, having a plurality of grippers, and conveying a clothes item gripped by the grippers into the case; a folding unit including a longitudinal-line folder folding both sleeves of the clothes item along longitudinal line to overlap and a transverse-line folder configured to fold the clothes item along a transverse line to overlap; and an unloading unit disposed at a lower portion of the case and conveying the clothes item folded by the folding unit outside the case, in which the longitudinal-line folder is disposed at a same single stage together with the loading unit, and the longitudinal-line folder includes: a main board supporting a body part of the clothes item conveyed by the loading unit such that the body part can slide; and a plurality of sub-boards spaced apart from each other in an up-down direction with different height differences with respect to the main board, installed such that a first side in a transverse direction can be rotated in the up-down direction about a second side, and simultaneously folding the sleeves along the longitudinal lines, respectively, simultaneously with conveying by the loading unit.

According to an example related to the another embodiment of the present disclosure, the second sides of the sub-boards may be coupled to first sides of a plurality of fixed plates by hinge shafts, respectively, the first sides of the sub-boards may be rotated in the up-down direction between a first position where the sub-boards are horizontally positioned and a second position where the sub-boards are inclined downward, and the fixed plates may be spaced apart from each other with different height differences with respect to the main board.

According to an example related to the another embodiment of the present disclosure, the clothes folding machine may further include driving motors driving the sub-boards such that the first sides of the sub-boards can be rotated, respectively.

A clothes folding machine according to another embodiment of the present disclosure includes: a case; a loading unit disposed at an upper portion of the case, having a plurality of grippers, and conveying a clothes item gripped by the grippers into the case; a folding unit including a longitudinal-line folder folding both sleeves of the clothes item along longitudinal line to overlap and a transverse-line folder configured to fold the clothes item along a transverse line; and an unloading unit disposed at a lower portion of the case and conveying the clothes item folded by the folding unit outside the case, in which the longitudinal-line folder is disposed at a same single stage together with the loading unit, and the longitudinal-line folder includes: a main board supporting a body part of the clothes item conveyed by the loading unit such that the body part can slide; a plurality of sub-boards spaced apart from each other in an up-down direction with different height differences with respect to the main board and horizontally disposed; and a plurality of folding blades mounted to be able to transversely rotate at the sub-boards, respectively, and folding the sleeves hanging down in a gravity direction from both side edges of the main board along longitudinal lengths by hitting the sleeves.

According to an example related to the another embodiment of the present disclosure, the clothes folding machine may further include driving motors disposed on bottom surfaces of the sub-boards, respectively, and driving the folding blades such that the folding blades can be rotated, respectively.

According to an example related to the another embodiment of the present disclosure, the sub-boards each may have a folding guide, and the folding guides each may include: an entry part transversely lined toward a downstream side from an upstream side of a path of the clothes item, and passing a sleeve folded by each of the folding blades inside each of the sub-boards; and a fold maintainer extending from the entry part in a longitudinal direction of the sub-board and keeping the sleeve folded.

Advantageous Effects

Effects of the clothes folding machine according to the present disclosure are as follows.

First, a plurality of sub-boards is mounted on fixed plates to be able to move in a transverse direction of the main board and transversely pushes both sleeves of a top, it is possible to simultaneously fold the sleeves of the top along longitudinal lines without interference. The movable sub-boards may also be called active type sub-boards.

That is, a plurality of active type sub-boards completely folds both sleeves of a clothes item along longitudinal lines at a time and simultaneously by pushing the clothes item in to the space under the main board across the sides of the main board.

Second, unlike the related art in which the height of folding machines is increased due to folding along the longitudinal lines that is performed several time at different stages, the folding machine of the present disclosure completes folding both sleeves along the longitudinal lines at one stage simultaneously with loading, the height of the folding machine can be considerably decreased and it is possible to greatly contribute to downsizing of a folding machine.

Third, a first fixed plate and a second fixed plate are spaced downward apart from each other with different height differences with respect to the main board, whereby passages for both sides of the body part and both sleeves of a top are formed. Further, both sides of the body part and both sleeves of a top pass through the passages formed between the main board and the fixed plates, whereby clothes are folded along the longitudinal lines simultaneously with loading. Accordingly, it is possible to fold clothes along the longitudinal lines while conveying the clothes minimum distance.

Fourth, a first side cover and a second side cover protrude from the lateral ends of the first fixed plate and the second fixed plate, respectively, and cover the gap between the fixed plates and the main board, whereby it is possible to prevent interference between both sleeves when a clothes item passes through the passages between the main board and the fixed plates.

Fifth, a plurality of sub-boards can be driven by power from the driving motors and the power can be transmitted to the sub-boards through a lead screw, a ball screw, a pinion and rack gear, or the like.

Sixth, a plurality of sub-boars extend in the transverse direction of the main board at first sides of the fixed plates and are spaced downward apart from each other with different height differences with respect to the main board, first sides of the sub-boards are hinged to the fixed plates, and second sides of the sub-boards can be rotated in the up-down direction, so it is possible to more easily fold both sleeves of a top along longitudinal lines.

Seventh, a folding blade that is rotated in the transverse direction of the main board is mounted on each of a plurality of sub-boards, and the folding blades hit and push both sleeves of a clothes item, which is loaded, inside the sub-boards, so it is possible to more easily fold both sleeves of a top along longitudinal lines.

BEST MODE

Figure 1:
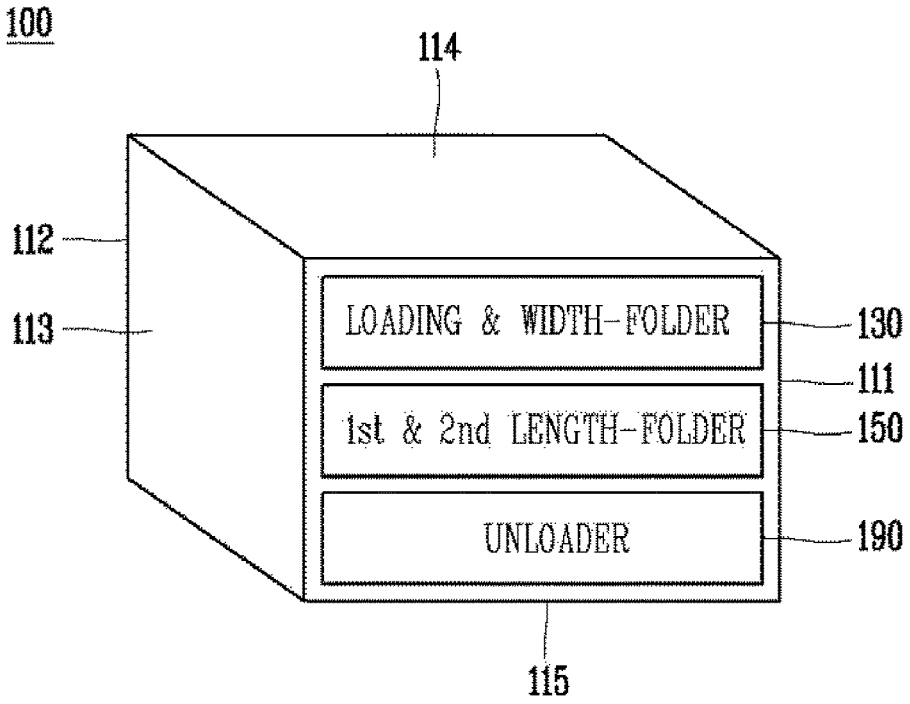
FIG. 1 is a conceptual view showing the external appearance of a clothes folding machine according to the present disclosure.

Hereafter, embodiments of the present disclosure will be described in detail with reference to the accompanying drawings and the same or similar components are given the same reference numerals regardless of the numbers of figures and are not repeatedly described. Terms "module" and "unit" that are used for components in the following description are used only for the convenience of description without having discriminate meanings or functions. In the following description, if it is decided that the detailed description of known technologies related to the present disclosure makes the subject matter of the embodiments described herein unclear, the detailed description is omitted. Further, the accompanying drawings are provided only for easy understanding of embodiments disclosed in the specification, the technical spirit disclosed in the specification is not limited by the accompanying drawings, and all changes, equivalents, and replacements should be understood as being included in the spirit and scope of the present disclosure.

Terms including ordinal numbers such as 'first', 'second', etc., may be used to describe various components, but the components are not to be construed as being limited to the terms. The terms are used only to distinguish one component from another component.

It is to be understood that when one element is referred to as being "connected to" or "coupled to" another element, it may be connected directly to or coupled directly to another element or be connected to or coupled to another element, having the other element intervening therebetween. On the other hand, it should be understood that when one element is referred to as being "connected directly to" or "coupled directly to" another element, it may be connected to or coupled to another element without the other element intervening therebetween.

Singular forms are intended to include plural forms unless the context clearly indicates otherwise.

It will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof.

FIG. 1 is a conceptual view showing the external appearance of a clothes folding machine 100 according to the present disclosure.

The clothes folding machine 100 is configured to automatically fold washed and dried clothes. The clothes include a top 10 and a bottom.

The top 10 (FIG. 4) that is an object to be folded by the clothes folding machine 100 is complicated to be folded in comparison to a bottom, the top 10 is mainly exemplified in the following description. However, the clothes folding machine 100 can fold both of a top 10 and a bottom.

The top 10 has a body part 11 and two sleeves 12 (arm parts). The body part 11 has a neck part and shoulder parts at the upper portion.

The top 10 may be folded by longitudinal-line folding that folds both sleeves 12 along longitudinal-lines 13 to overlap and transverse-line folding that folds the body part 11 several times along a transverse line to overlap.

The longitudinal-lines 13 are straight lines longitudinally extending from left and right shoulder lines with the neck part therebetween.

The transverse line is a straight line transversely extending across both sides of the body part 11. A primary transverse line is a folding line that crosses a longitudinal portion of the body part 11 in the width direction and a secondary transverse line is a folding line that crosses another longitudinal portion (close to the neck part) in the width direction.

The clothes folding machine 100 of the present disclosure includes a case 110. The case 110 forms the external shape. The case 110 may be a rectangular parallelepiped. The case 110 has a front surface, a rear surface, two sides, a top surface, and a bottom surface inside which clothes are loaded.

The case 110 includes a front panel 111 forming the front surface, a rear panel 112 forming the rear surface, side panels 113 forming the sides, a top panel 114 forming the top surface, and a bottom panel 115 forming the bottom surface. The case 110 has an accommodation space therein to be able to accommodate several components.

An opening may be formed at the upper portion and the lower portion of the front panel 111. The upper opening is open as a passage for loading clothes and the lower opening is open as a passage for discharged folded clothes to the outside.

The clothes folding machine 100 includes a loading unit 130, a folding unit 150, and an unloading unit 190.

The loading unit 130 is disposed at the upper portion of the case 110 to load clothes into the case 110.

The folding unit 150 is disposed at the middle in the height direction of the case 110 to fold clothes several times along transverse lines or longitudinal-lines 13.

The folding unit 150 includes a longitudinal-line folder 151 that performs longitudinal-line folding and a transverse-line folder 170 that transverse-line folding. However, the longitudinal-line folder 151 are disposed at the upper portion of the case 110 together with the loading unit 130 and can perform loading and longitudinal-line folding on clothes.

The unloading unit 190 is configured to discharge folded clothes out of the case 110.

Figure 2:
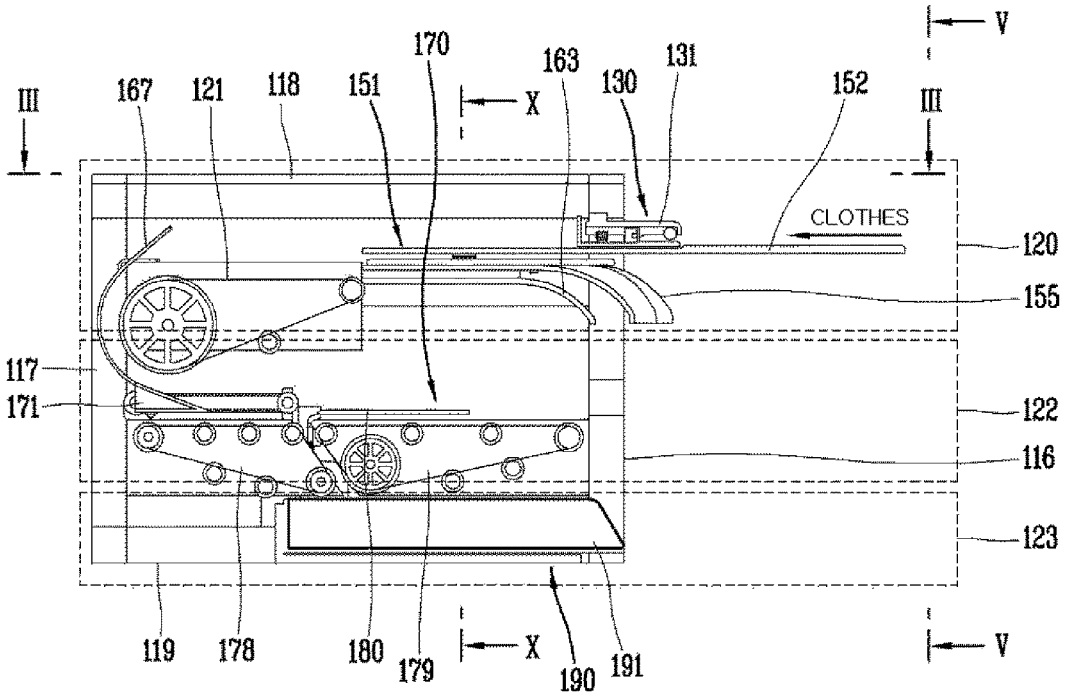
FIG. 2 is a conceptual view showing the state in which a loading unit, a folding unit, and an unloading unit are installed in a case in FIG. 1.
Figure 3:
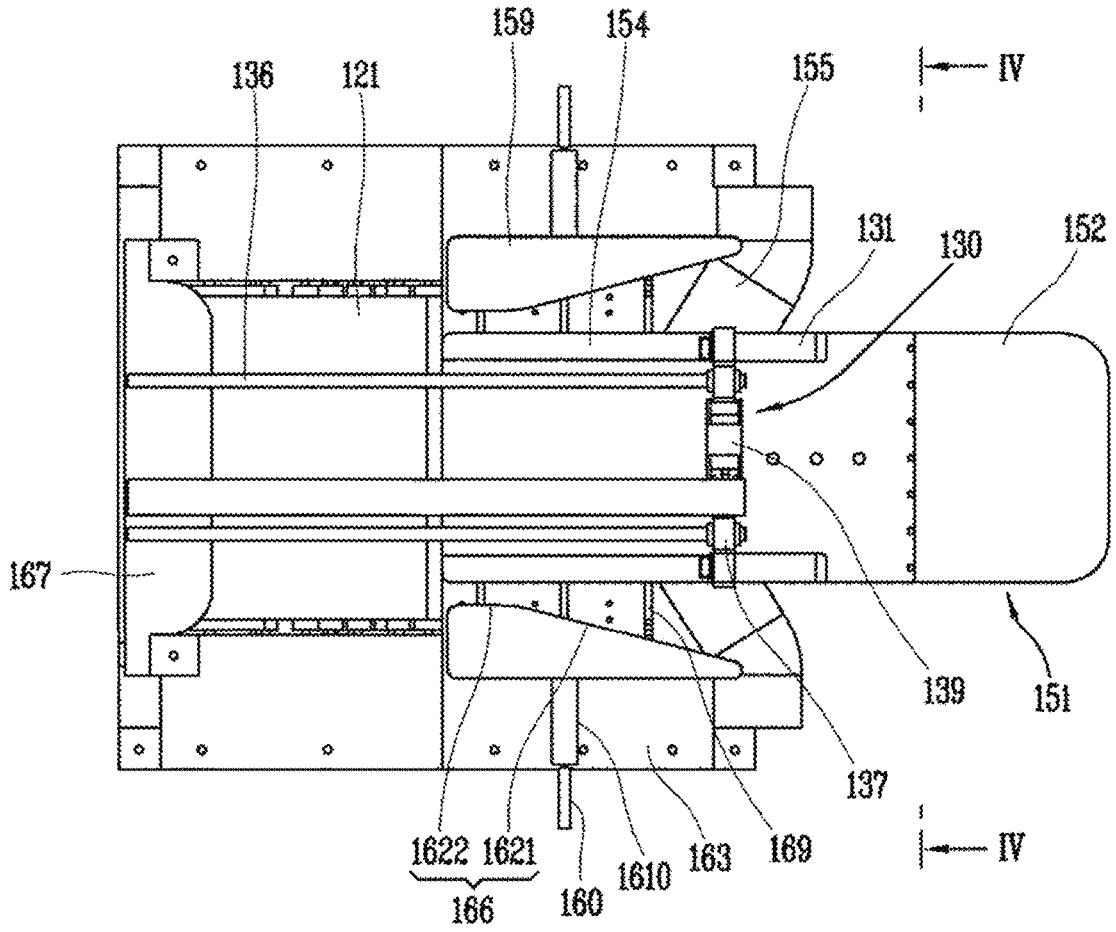
FIG. 3 is a plan view taken along line shown in FIG. 2, that is, a conceptual view showing the state in which the sub-boards are mounted to be able to transversely move along a fixed plate.
Figure 4:
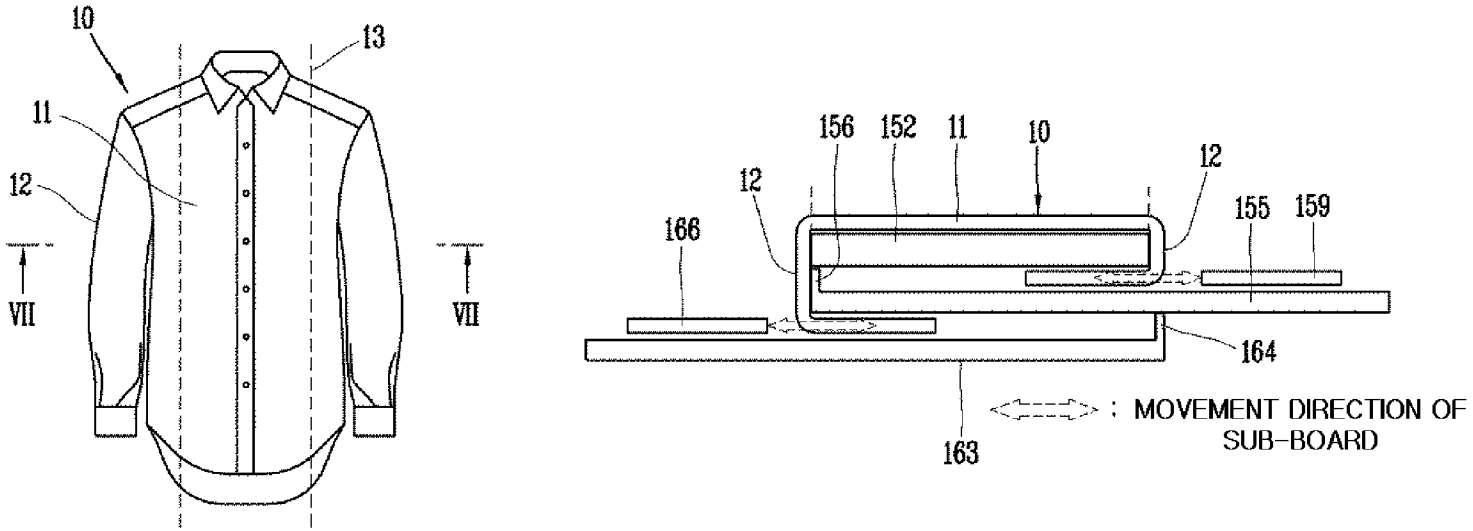
FIG. 4 is a front view taken along line IV-IV shown in FIG. 3, that is, a conceptual view showing the state in which the sub-boards are spaced apart from each other with different height differences under a main board and are transversely moved.
Figure 5:
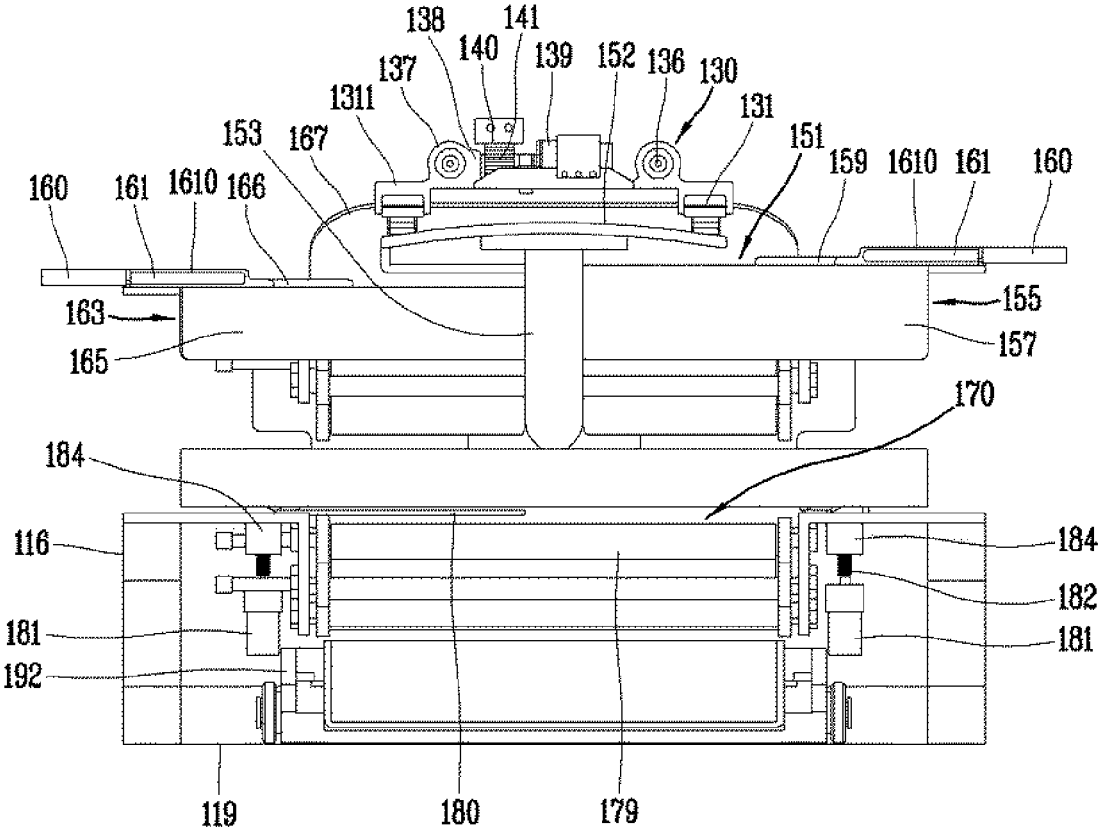
FIG. 5 is a front view taken along line V-V shown in FIG. 2.
Figure 6:
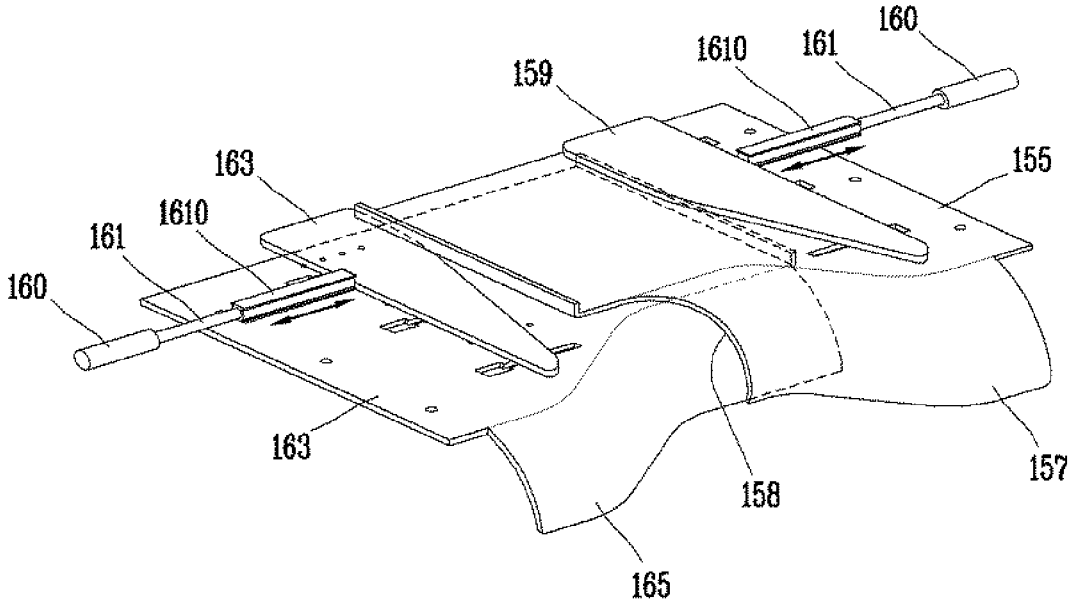
FIG. 6 is a perspective view showing the state in which the sub-boards are mounted on the fixed plate in FIG. 3.

FIG. 2 is a conceptual view showing the state in which the loading unit 130, the folding unit 150, and the unloading unit 190 are installed in the case 110 in FIG. 1, FIG. 3 is a plan view taken along line shown in FIG. 2, that is, a conceptual view showing the state in which the sub-boards are mounted to be able to transversely move along a fixed plate, FIG. 4 is a front view taken along line IV-IV shown in FIG. 3, that is, a conceptual view showing the state in which the sub-boards are spaced apart from each other with different height differences under a main board and are transversely moved, FIG. 5 is a front view taken along line V-V shown in FIG. 2, and FIG. 6 is a perspective view showing the state in which the sub-boards are mounted on the fixed plate in FIG. 3.

A plurality of frames is installed in the case 110, thereby being able to form a framework. The frames include front frames 116, rear frames 117, top frames 118, and bottom frames 119.

The front frames 116 may be vertically installed at the left and right edges of the front surface of the case 110, respectively. The rear frames 117 may be vertically installed at the left and right edges of the rear surface of the case 110, respectively.

The top frames 118 are horizontally installed on the upper ends of the front frames 116 and the upper ends of the rear frames 117, respectively, to connect the front frames 116 and the rear frames 117 to each other.

The bottom frames 119 are horizontally installed at the lower ends of the front frames 116 and the lower ends of the rear frames 117, respectively, to connect the front frames 116 and the rear frames 117 to each other.

The loading unit 130, the folding unit 150, and the unloading unit 190 may be stacked in the case 110.

For example, when the accommodation space of the case 110 is divided into an upper stage 120, a middle stage 122, and a lower stage 123, the loading unit 130 and the longitudinal-line folder 151 of the folding unit 150 may be disposed at the upper stage 120, the transverse-line folder 170 of the folding unit 150 may be disposed at the middle stage 122, and the unloading unit 190 may be disposed at the lower stage 123.

The loading unit 130 is disposed at the top frames 118 to convey clothes into the accommodation space in the case 110.

The loading unit 130 includes a plurality of grippers 131. The grippers 131 may be configured to grip the left and right sides of the shoulder part of the top 10, respectively. The gripper 131 may be implemented like tongs. The gripper 131 includes an upper gripper member and a lower gripper member.

Hinge portions protrude at the longitudinal center portions of the upper gripper member and the lower gripper member to laterally overlap each other, respectively, and are coupled to each other by a hinge pin. Accordingly, the front ends of the upper gripper member and the lower gripper member can be opened or closed by rotating up and down about the hinge pin.

A small roller is installed at the front end of the upper gripper member, so clothes are easily inserted between the upper gripper member and the lower gripper member when the clothes are gripped.

A spring is installed between the rear ends of the upper gripper member and the rear gripper member. The spring has elasticity in a direction in which the rear ends of the upper gripper member and the rear gripper member are opened up and down.

A release protrusion that protrudes upward may be formed on the bottom of the rear end of the lower gripper member to cover the rear end of the upper gripper member.

According to this configuration, the shoulder part of the top 10 may be gripped between the front ends of the upper gripper member and the lower gripper member.

When the upper end of the release protrusion is pressed toward the front of the gripper 131, the rear end of the lower gripper member which is connected with the release protrusion is rotated toward the rear end of the upper gripper member against the elasticity of the spring, whereby a clothes item gripped between the front ends of the upper gripper member and the lower gripper member can be released.

The loading unit 130 is configured to move in the front-rear direction toward the rear surface from the front surface of the case 110.

A gripper driving unit and a guide rod 136 for moving the gripper 131 in the front-rear direction mounted on the top frame 118.

The guide rods 136 are configured to move in the front-rear direction of the case 110 with the grippers 131 hanging thereon, respectively. A gripper support 1311 may be formed in a "⊏" shape or a "U" shape and coupled to the rear end of the upper gripper member of the gripper 131.

The guide rod 136 may be a circular bar. Conveying guides 154 may be horizontally elongated toward the rear surface from the front surface of the case 110.

The guide rods 136 are mounted on the top frames 118, respectively, to be laterally movable left and right, so the gap therebetween can be adjusted. The gaps between the grippers 131 can be adjusted together with the guide rods 136 in accordance with the sizes of clothes.

Each of a plurality of guide rings 137 extends toward the guide rod 136 from a side of the gripper support 111, is formed in a cylindrical shape to surround the guide rod 136, and can be moved in the front-rear direction with the gripper 131 hanging thereon.

The guide rings 137 may be connected by a transverse member 138 horizontally extending left and right. The transverse member 138 may connect the guide rings 137 as one or two members.

For example, in order to adjust the lateral gap between the gripper 131, the transverse members 138 are configured such that any one of two circular pipes having different diameters is longitudinally inserted into and pulled out of the other one to be able to adjust the length, whereby the lateral gap of the transverse members 138 can be adjusted.

The gripper driving unit includes a gripper-driving motor 139 and a power transmitter. The power transmitter may be implemented by a rack gear 140 and a pinion gear 141. The gripper-driving motor 139 may be mounted on the transverse member 138.

The pinion gear 141 may be connected by a rotary shaft laterally extending from the griper-driving motor 139. The rack gear 140 may horizontally extend in the front-rear direction from the front end to the rear end of the top frame 118.

A plurality of gear teeth is formed on the bottom of the rack gear 140, so the rack gear can be engaged with the pinion gear 141.

The rotary shaft may be connected to the guide ring 137 through the pinion gear 141 from the gripper-driving motor 139.

According to this configuration, when the gripper-driving motor 139 is operated, the pinion gear 141 is rotated with the rotary shaft and is moved in the front-rear direction along the rack gear 140, whereby the gripper 131 can be moved in the front-rear direction.

The longitudinal-line folder 151 may be configured such that loading and longitudinal-line folding of a clothes item can be finished on one stage. For example, the longitudinal-line folder 151 may simultaneously fold both sleeves along longitudinal lines 13 at both sides at the upper stage 120.

To this end, the longitudinal-line folder 151 is disposed at the upstream side of the path of clothes and includes a main board 152 and a plurality of sub-boards 159 and 166.

The main board 152 is configured to support the body part 11 of the top 10 such that the body part 11 can slide in the front-rear direction from the front surface to the rear surface of the case 110.

The main board 152 may be formed in a rectangular shape when seen downward from the top surface of the case 110. The corners of the main board 152 may be rounded. The main board 152 may be formed such that that longitudinal length (length) is larger than the transverse length (width).

The length of the main board 152 may be larger twice or more than the width. The width of the main board may be smaller than the shoulder width of the top 10.

According to this configuration, portions of both sides of the body part 11 and both sleeves 12 of the top 10 may hang down in the gravity direction from both side edges while the main board 152 supports the body part 11 of the top 10.

Since both sides of the body part 11 of the top 10 are curved in the gravity direction along both side edges of the main board 152, both side edges of the main board 152 can longitudinally form longitudinal lines 13 from the shoulder lines at both sides of the body part 11.

The front of the main board 152 protrudes forward further than the front ends of the sub-board 159 and 166, so the top 10 can be easily loaded. The protrusion length of the front of the main board 152 may be larger than the distance from a transverse straight line passing the ends of both shoulder lines of the top 10 to the upper end of the center of the neck part.

The front of the main board 152 protruding further than the sub-boards 159 and 166 is inclined downward, so the top 10 can be smoothly loaded.

For example, a longitudinal side of the top 10 is positioned higher than the other side of the top 10 as it goes to the upper portion of the front of the main board 152, so the shoulder part of the top 10 is easily gripped between the upper gripper member and the lower gripper member.

The main board 152 may be convexly protrude upward at the center portion further than both side edges when seen rearward from the front of the case 110. The main board 152 may be formed in a curved arc shape.

According to this configuration of the main board 152, an effect that the body part 11 of the top 10 is straightened to both left and right edges from the center of the main board 152 by gravity.

The sub-boards 159 and 166 are mounted on the fixed plates 155 and 163 to be transversely slidable.

The sub-boards 159 and 166 are spaced downward apart from each other with different height differences with respect to the main board 152.

The sub-boards 159 and 166 may slide in opposite directions with different height differences with respect to the main board 152.

The sub-boards 159 and 166 may be a first sub-board 159 and a second sub-board 166.

The first sub-board 159 may be disposed under the main board 152 with a first gap (gap 1) from the main board 152 and the second sub-board 166 may be disposed lower than the first sub-board 159 with a second gap (gap 2) from the first sub-board 159.

The first gap and the second gap may be the same.

For longitudinal-line folding of both sleeves 12, the first sub-board 159 is disposed to be movable to the left from the right when seen rearward from the front of the case and the second sub-board 166 is disposed to be movable to the right from the left, so when the first sub-board 159 and the second sub-board 166 are moved toward each other, both sleeves 12 and portions of both sides of the body part 11 that hang down in the gravity direction from both side edges of the main board 152 can be simultaneously folded.

The longitudinal line 13 may be composed of a first longitudinal line 13 formed at the right side of the body part 11 and a left longitudinal line 13 formed at the left side of the body part 11.

According to this configuration, when the first sub-board 159 and the second sub-board 166 are transversely moved at different heights, both sleeves 12 can be simultaneously folded along the first and second longitudinal lines 13 while being transversely fully moved without interference from both side edges of the main board 152 by the first sub-board 159 and the second sub-board 166.

The sub-boards 159 and 166 each may be formed in a plate shape.

The sub-boards 159 and 166 may be horizontally disposed on the fixed plates 155 and 163, respectively.

The sub-boards 159 and 166 each may be formed in a trapezoidal shape of which two edges transversely facing each other are parallel with each other.

The sub-boards 159 and 166 each may be composed of an entry guide 1621 and a fold maintainer 1622.

The entry guide 1621 is formed such that the width gradually increases from the upstream side to the downstream side of the path of clothes for easy entry of clothes.

The entry guide 1621 of the first sub-board 159 may inclined left from the right edge to the left edge and the entry guide 1621 of the second sub-board 166 may be inclined right from the left edge to the right edge.

The transverse gap between the entry guide 1621 of the first sub-board 159 and the entry guide 1621 of the second sub-board 166 may decrease from a first gap to a second gap as it goes to the downstream side from the upstream side of the path of clothes. The first gap is larger than the second gap, so clothes easily enter between the first and second sub-boards 159 and 166.

The fold maintainer 1622 has a constant longitudinal width and may make the left edges and right edges of the sub-boards 159 and 166, which transverse face each other, parallel. The left and right edges of the fold maintainer 1622 may be disposed in parallel with the longitudinal-folding lines 13.

The width of the fold maintainer 1622 is the same as the maximum width of the rear end of the entry guide 1621.

The fold maintainer 1622 of the first sub-board 150 and the fold maintainer 1622 of the second sub-board 166 can maintain the same gaps in the transverse direction.

According to this configuration, the fold maintainers 1622 maintain the same gaps in the transverse direction, whereby both sleeves 12 can be maintained in the state folded along the longitudinal lines 13 when the top passes through between the sub-boards.

The fixed plates 155 and 165 are spaced apart from each other under the main board 152.

The fixed plates 155 and 163 are configured to support the sub-boards 159 and 166 such that the sub-boards can transversely slide. The fixed plates 155 and 163 may be formed larger than the sub-boards 159 and 166.

The sub-boards 159 and 166 may be movably mounted on the top surfaces of the fixed plates 155 and 163.

The front ends of the fixed plates 155 and 163 may protrude to the front of the case further than the sub-boards 159 and 166.

A guide groove and a guide protrusion may be formed between the sub-boards 159 and 166 and the fixed plates 155 and 163.

For example, a plurality of guide protrusions may protrude downward from the bottom surfaces of the sub-boards 159 and 166 and the guide protrusions may be longitudinally spaced apart from each other.

A plurality of guide grooves may transversely extend on the fixed plates 155 and 163.

The guide protrusions are inserted in the guide grooves, respectively, thereby being able to support the sub-boards 159 and 166 such that the sub-boards can transversely slide.

The fixed plates 155 and 163 may form the passage for clothes such that clothes pass through between the sub-boards 159 and 166, and may guide clothes to the sub-boards.

The fixed plates 155 and 163 can guide both sleeves 12 such that both sleeves 12 are moved to the sub-boards 159 and 166 without interference with each other.

The fixed plates 155 and 163 include a first fixed plate 155 and a second fixed plate 163. An end of each of the first fixed plate 155 and the second fixed plate 163 may be attached to the left and right side panels 113 or may be attached and supported to the left and right side frames connecting the centers of the front frame 116 and the rear frame 117.

The first fixed plate 155 may horizontally extend toward the left side from the right side of the case 110. The second fixed plate 163 may horizontally extend toward the right side from the left side of the case 110.

The first fixed plate 155 and the second fixed plate 163 may be disposed at the left and right sides of the main board 152, respectively, with different height differences from the main board 152.

The first fixed plate 155 and the second fixed plate 163 may be spaced up and down apart from each other. The first fixed plate 155 and the second fixed plate 163 may be disposed to partially overlap each other in the up-down direction.

The first fixed plate 155 and the second fixed plate 163 may be disposed to partially overlap the main board 152 in the up down direction.

The first fixed plate 155 may extend to a second edge (left edge) across a first edge (right edge in the figures) of the main board 152 while maintaining a predetermined first gap GAP 1 with respect to the main board 152.

The second fixed plate 163 is disposed under the first fixed plate 155 and may extend to the first edge (right edge) across the second edge (left edge) of the main board 152 while maintaining a second gap with respect to the first fixed plate 155.

According to this configuration, when the top 10 is conveyed rearward from the front end of the main board 152 by the loading unit 130, the first fixed plate 155 can guide a first sleeve 12 of the top 10 hanging down in the gravity direction from a side edge of the main board 152 to the first sub-board 159.

In this case, the first sub-board 159 slides to the left from the right and pushes a side of the body part 11 or the first sleeve 12 to a first passage between the main board and the first fixed plate, whereby the first sleeve 12 can be folded along the first longitudinal line 13 to overlap the body part 11.

The second fixed plate 163 can guide a second sleeve 12 of the top 10 hanging down in the gravity direction from a side edge of the main board 152 to the second sub-board 166.

In this case, the second sub-board 166 slides to the right from the left and pushes a side of the body part 11 or the first sleeve 12 to a second passage between the main board and the second fixed plate, whereby the second sleeve 12 can be folded along the second longitudinal line 13 to overlap the body part 11.

Accordingly, since the first sub-board 159 and the second sub-board 166 are transversely moved with respect to the main board 152, while the top 10 passes the main board 152 and the sub-boards 159 and 166 simultaneously with loading, both sleeves 12 are simultaneously folded without interference with each other at the upper stage 120 of the case 110.

The first fixed plate 155 and the second fixed plate 163 each may further have a first side cover 156 and a second side cover 164.

The first side cover 156 may protrude upward from a first end of the first fixed plate 155 to cover the first gap GAP 1 between the second edge of the main board 152 and a first end of the first sub-board 159.

According to this configuration, the first fixed plate 155 allows the first sleeve 12 of the top 10 to be laterally folded and inserted between the main board 152 and the first fixed plate 155 through the gap GAP 1 between the first fixed plate 155 and the first edge of the main board 152, but the first side cover 156 not only can prevent the second sleeve 12 from being inserted between the main board 152 and the first fixed plate 155 through the first gap GAP 1, but can prevent the first sleeve 12 folded already from separating out of the first fixed plate 155.

The second fixed plate 163 allows the second sleeve 12 of the top 10 to be laterally folded and inserted between the main board 152 and the second fixed plate 163 through the gap GAP 2 between the second fixed plate 163 and the second edge of the main board 152, but the second side cover 163 not only can prevent the first sleeve 12 from being inserted between the first fixed plate 155 and the second fixed plate 163 through the second gap GAP 2, but can prevent the second sleeve 12 folded already from separating out of the second fixed plate 163.

The first side cover 156 and the second side cover 164 support portions of both sides of the body part 11 of the top 10 hanging down in the gravity direction from both side edges of the main board 152, respectively, thereby being able to laterally guide both sleeves 12 of the top to the first gap GAP 1 the second gap GAP 2 spaced apart from each other.

A support 153 for supporting the front lower portion of the main board 152 may be disposed at the front frame 116. The support 153 extends to be inclined in the front-rear direction, the lower end of the support 153 is coupled to a transverse connection frame connecting the middle portions of both sides of the front frame 116, and the upper end of the support frame 153 is coupled to a side of the bottom surface of the main board 152, thereby being able to support the main board 152.

A first front guide 157 may be disposed at the front end of the first fixed plate 155. The first front guide 157 may be formed in a curved shape with a predetermined curvature to be inclined downward at a predetermined angle from the front end of the first fixed plate 155 or to be inclined downward toward the front of the first fixed plate 155.

In this embodiment, the first front guide 157 is shown as a curved shape. The first front guide 157 is formed to bend downward as it goes forward from the first fixed plate 155.

According to this configuration, the first front guide 157 lifts the first sleeve 12 hanging down in the gravity direction from the first edge of the main board 152 when the top 10 approaches the first fixed plate 155, so the first sleeve 12 easily approaches.

A second front guide 165 may be disposed at the front end of the second fixed plate 163. The second front guide 165 may be formed in a curved shape with a predetermined curvature to be inclined downward at a predetermined angle from the front end of the second fixed plate 163 or to be inclined downward toward the front of the second fixed plate 163.

In this embodiment, the second front guide 165 is shown as a curved shape. The second front guide 165 is formed to bend downward as it goes forward from the second fixed plate 155.

According to this configuration, the second front guide 165 lifts the second sleeve 12 hanging down in the gravity direction from the second edge of the main board 152 when the top 10 approaches the second fixed plate 163, so the second sleeve 12 can easily approach.

The first front guide 157 may be formed to be recessed toward the rear from the front as it goes from the right side to the left side in the width direction. The right end of the first front guide 157 may protrude forward further than the left end (recessed portion) of the first front guide 157.

The second front guide 165 may be formed to be recessed toward the rear from the front as it goes from the left side to the right side in the width direction. The left end of the second front guide 165 may protrude forward further than the right end (recessed portion) of the second front guide 165.

The left end (recessed portion) of the first front guide 157 may protrude forward further than the right end (recessed portion) of the second front guide 165.

According to this configuration, the first front guide 157 and the second front guide 165 can guide both sleeves 12 to be laterally folded toward each other, respectively, when both sleeves 12 approach the first fixed plate 155 and the second fixed plate 163, respectively.

The first front guide 157, when seen from the front of the case 110, may be spaced away from the main board 152 with a gap therebetween as it goes from the right end to the left end of the first fixed plate 155 in the width direction such that the front left end of the first front guide 157 extends to the width-directional center of the main board 152 across the first edge (right edge) of the main board 152.

The second front guide 165, when seen from the front of the case 110, may be spaced away from the main board 152 with a gap therebetween as it goes from the left end to the right end of the second fixed plate 155 in the width direction such that the front right end of the second front guide 165 extends to the first edge (right edge) of the main board 152 across the second edge (left edge) of the main board 152.

The first front guide 157 and the second front guide 165 may be disposed to partially overlap in the front-rear direction and the up-down direction.

An opening 158 may be formed at the left end of the first front guide 157. The opening 158 may be rounded. The lateral length of the first front guide 157 may be smaller by the lateral distance of the opening 158 than the lateral length of the second front guide 165.

According to this configuration, when the top 10 is loaded and conveyed rearward, the first front guide 157 allows the right sleeve 12 to approach the first fixed plate 155 while lifting the right sleeve 12 and the second front guide 165 lifts the left sleeve 12. The opening can prevent the left sleeve 12 from interfering with the first front guide 157 when the left sleeve 12 approaches the second fixed plate 163.

Figure 7:
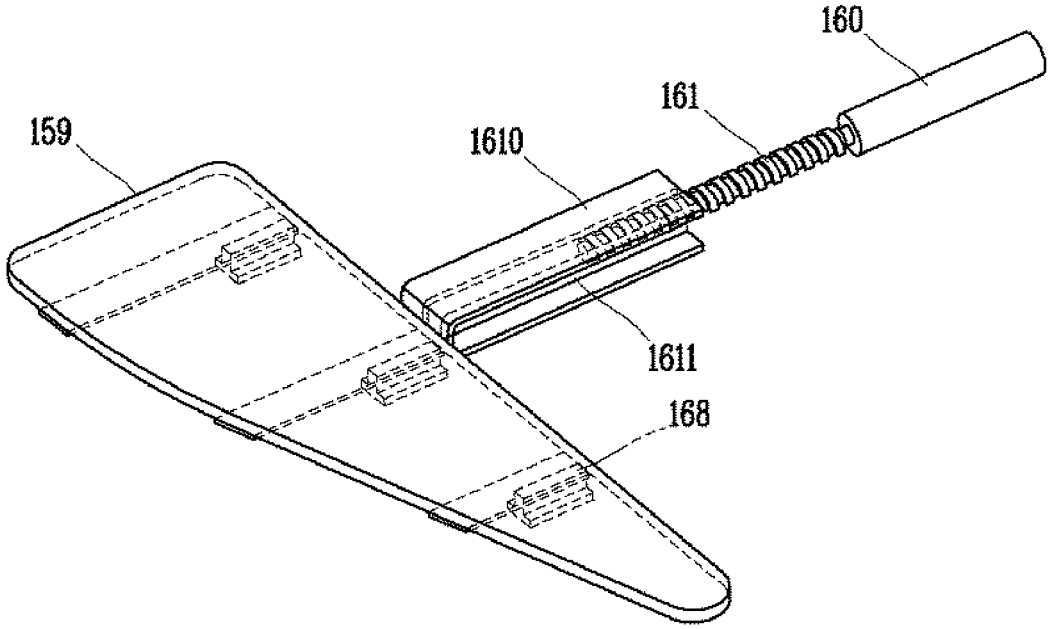
FIG. 7 is a conceptual view showing an embodiment of an actuator that drives the sub-boards of the present disclosure.

FIG. 7 is a conceptual view showing an embodiment of an actuator that drives the sub-boards 159 and 166 of the present disclosure.

In this embodiment, the actuators of the sub-boards 159 and 166 each may be composed of a driving motor 160, a screw 161, and a sliding member 1610.

The sliding member 1610 is connected to a side edge of each of the sub-boards 159 and 166. The sliding member 1610 may be integrally formed with the sub-boards 159 and 166. The sliding member 1610 may be integrally formed with the sub-boards 159 and 166.

A nut portion 1611 may be formed inside the sliding member 1610. The nut portion 1611 may be formed like a female thread on the bottom surface of the sliding member 1610 to couple the screw 161.

The screw 161 is connected with the driving motor 160 to rotate with the driving motor 160.

The screw 161 may extend from a side edge of the sub-boards 159 and 166 and may be thread-fastened to the nut portion 1611 of the sliding member 1610.

According to this configuration, when the driving motors 160 are driven, the screws 161 are rotated. As the screws 161 are rotated, the sliding members 1610 slide along the screws 161 in the transverse direction of the fixed plates 155 and 163, so the sub-boards 159 and 166 can be moved with the sliding members 1610 in the transverse direction of the fixed plates 155 and 163.

Figure 8:
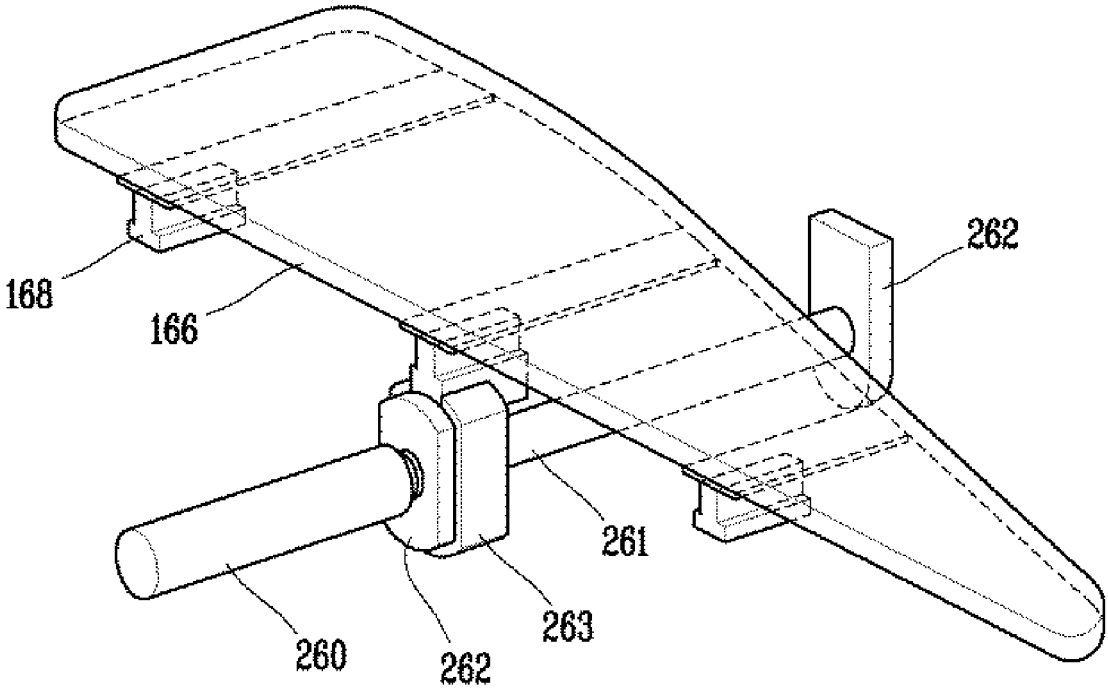
FIG. 8 is a conceptual view showing another embodiment of an actuator that drives the sub-boards of the present disclosure.

FIG. 8 is a conceptual view showing another embodiment of an actuator that drives the sub-boards 159 and 166 of the present disclosure.

The sub-boards 159 and 166 can be driven by a driving motor 360.

In this embodiment, the actuator of the sub-boards 260 and 166 may be composed of a driving motor 260, a ball screw 261, and a slider 263.

The ball screw 160 is connected with the rotary shaft of the driving motor 260 and can be rotated. The ball screw 160 is configured to convert the rotational motion of the motor 260 into a straight motion.

The front end and the rear end of the ball screw 261 may be rotatably supported by bearings.

The bearings may be installed in a plurality of supports 262. The supports 262 may be installed to be fixed to the fixed plates 155 and 163. The supports 262 may be vertically disposed on the fixed plates 155 and 163.

The slider 263 has a female thread therein and a plurality of ball bearings is installed between the female thread of the slider 263 and the ball screw 261 such that the slider 263 can be moved straight by rotation of the ball screw 261.

The slider 263 is connected to an edge of the sub-boards 159 and 166, so the sub-boards 159 and 166 can be laterally moved with the sliders 263 by rotation of the driving motors and the ball screws 160.

According to this configuration, the sub-boards 159 and 166 are mounted on the fixed plates in an active type to be able to transversely slide, whereby it is possible to simultaneously fold both sleeves 12 by pushing a portion of the body part 11 of the top 10 or the sleeves 12 inside both side edges of the main board 152.

Figure 9:
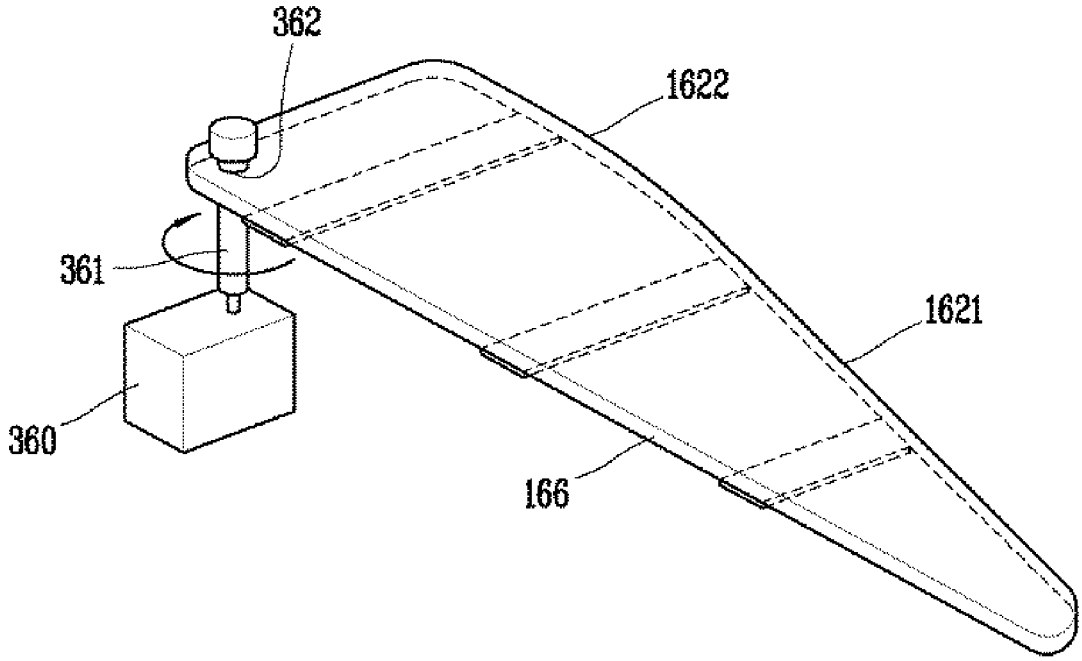
FIG. 9 is a conceptual view showing another embodiment of an actuator that drives the sub-boards of the present disclosure.

FIG. 9 is a conceptual view showing another embodiment of an actuator that drives the sub-boards 159 and 166 of the present disclosure.

This embodiment is different from the sub-boards 159 and 166 described above in that the sub-boards 159 and 166 are mounted to be laterally rotatable. The sub-boards 159 and 166 may be rotatably mounted on the fixed plates 155 and 163, respectively.

The sub-boards 159 and 166 can be transversely rotated between a first position and a second position.

The sub-boards 159 and 166 may be disposed in parallel by opening toward the upstream side of the path of clothes at the first position.

The sub-boards 159 and 166 may be disposed to close toward each other in the transverse direction of the fixed plates 155 and 163 at the second position.

The sub-boards 159 and 166 can be horizontally rotated with different height differences with respect to the main board 152.

Actuators for driving the sub-boards 159 and 166 each include a driving motor 360 and a rotary shaft 361.

The driving motors 360 may be mounted on the fixed plates 155 and 163. The rotary shaft 361 may be vertically disposed. A first side of the rotary shaft 361 may be connected with the motor shaft of the driving motor and a second side of the rotary shaft 361 may be coupled to each of the sub-boards 159 and 166.

A coupling hole 362 may be formed through a corner of each of the sub-boards 159 and 166. The coupling hole 362 may be formed at the right corner of the rear end of the fold maintainer 1622. The sub-boards 159 and 166 are coupled to the rotary shafts to be able to rotate a predetermined angle with the rotary shafts.

For example, the coupling holes 362 of the sub-boards 159 and 166 and the rotary shafts 361 may be coupled by a key, a serration, or a spline, so torque of the driving motors can be transmitted to the sub-boards 159 and 166 through the rotary shafts.

The upper ends of the rotary shafts 361 may be coupled to the sub-boards 159 and 166 by a rivet.

The driving motor 360 is configured to be able to rotate in two directions (forward or backward).

According to this configuration, when the driving motors 360 are driven, the sub-boards 159 and 166 are rotated to open in parallel toward the upstream side of the path of clothes or to close at a predetermined angle horizontally in the transverse direction of the main board 152. Accordingly, a clothes item 10 is loaded into the case 110 and both sleeves 12 thereof are simultaneously folded in the transverse direction of the main board 152 by rotation of the sub-boards 159 and 166.

Figure 10:
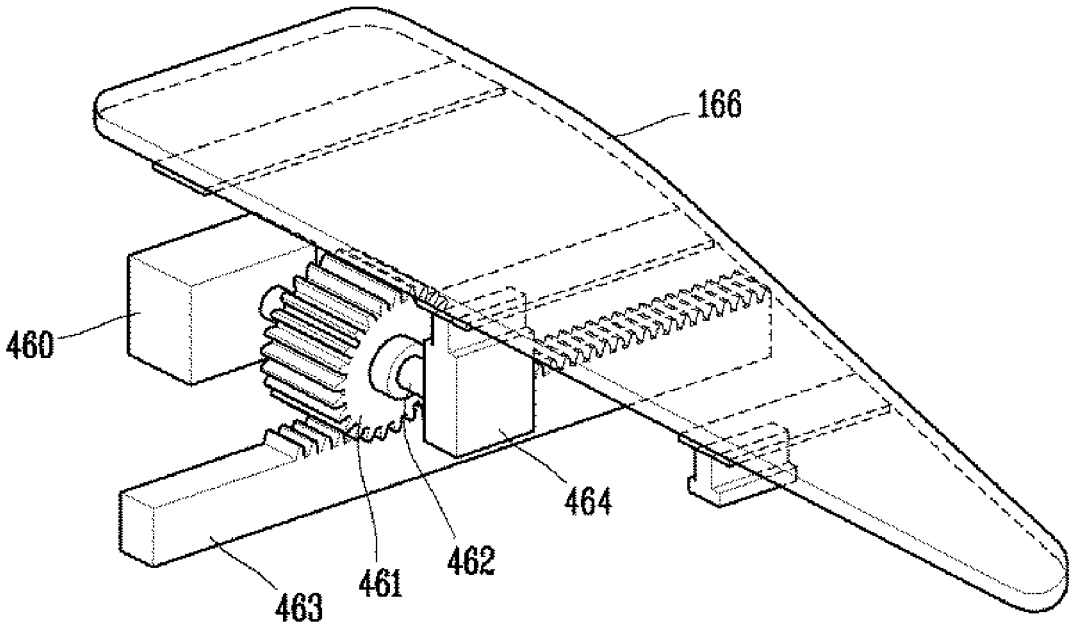
FIG. 10 is a conceptual view showing another embodiment of an actuator that drives the sub-boards of the present disclosure.

FIG. 10 is a conceptual view showing another embodiment of an actuator that drives the sub-boards 159 and 166 of the present disclosure.

The actuators of the sub-boards 159 and 166 according to this embodiment each include a driving motor 460, a pinion gear 461, and a rack gear 463.

The driving motor 460 and the pinion gear 461 may be mounted on each of the sub-boards 159 and 166.

The pinion gear 461 is connected to the driving motor 460 through a shaft 462, so it is driven to rotate by the driving motor 460. A side of the shaft 462 may be connected with the driving motor 460, the shaft 462 may axially pass through the center of the pinion gear 461, and a second side of the shaft may be rotatably supported by a support 464.

A bearing is installed inside the support 464 and can rotatably support the second side of the shaft 462.

The upper portion of the support 464 may be coupled to or integrally formed with the bottom surface of each of the sub-boards 159 and 166.

The rack gear 463 may be disposed under the pinion gear 461 to be engaged with the pinion gear 461. The rack gear 463 may extend in the transverse direction of the fixed plates 155 and 163 and may be mounted to be fixed.

According to this configuration, when the driving motors 460 are driven, the pinion gears 461 are rotated with respect to the rack gears 463 and the sub-boards 159 and 166 can be moved straight in the transverse direction of the fixed plates 155 and 163.

The sub-boards 159 and 166 transversely slide with different height differences with respect to the main board 152 on the top surfaces of the fixed plates 155 and 163, whereby it is possible to simultaneously fold both sleeves 12 of the top, which is loaded into the case 110 by the loading unit 130, along the longitudinal lines 13 to overlap.

Conveying guides 154 may be concavely formed in the transverse direction on the top surface of both side edges of the main board 152. The conveying guides 154 may be stepped downward from the top surfaces of both side edges of the main board 152.

The conveying guide 154 is formed flat and the width of the conveying guide 154 may be the same as or slightly larger than the left-right width of the gripper 131.

The length of the conveying guide 154 may correspond to the movement range of the gripper 131 that is moved reward from the front surface of the case 110. The conveying guide 154 does not need to be formed at the front of the main board 152 that protrudes forward from the front surface of the case 110.

The bottom surface of the gripper 131 is positioned lower than the top surface of the main board 152.

The bottom surface of the gripper 131 may be spaced apart from the conveying guide 154 in the up-down direction with a predetermined gap 1790 within 2 mm therebetween.

According to this configuration, since the conveying guide 154 is spaced apart from the bottom surface of the gripper 131 with a predetermined gap 1790 therebetween, the conveying guide 154 can guide the gripper 131 moving in the front-rear direction with the bottom surface of the gripper 131 maintaining the gap 1790 from the conveying guide 154.

Further, since the bottom surface 131 is spaced apart from the top surface of the conveying guide 154 with a gap, for example, within 2 mm, when the top 10 is loaded, the height difference between the shoulder part of the top 10 that is gripped by the grippers 131 and the bottom part 11 of the top 10 which is placed on the main board 152 can be minimized.

When a gap over a good size (e.g., over 2 mm) is generated between the bottom surface of the gripper 131 and the conveying guide 154 of the main board 152, the shoulder line portion of the top 10 is folded while being lifted by the gap from the conveying guide.

Accordingly, when the top 10 is released from the grippers 131, the shoulder line portions of the top 10 lifted up are moved down to the upper conveyer 121 in the gravity direction, so there may be a problem the longitudinal lines 13 supposed to be formed at both shoulder line portions of the top 10 are twisted unlike the intention.

Accordingly, it is preferable to minimize the height of the shoulder line portions lifted from the top surface of the main board 152 by positioning the bottom surfaces of the grippers 131 as close as possible to the conveying guides 154 on the surfaces of both side edges of the main board 152 with a minimum gap therebetween.

Figure 11:
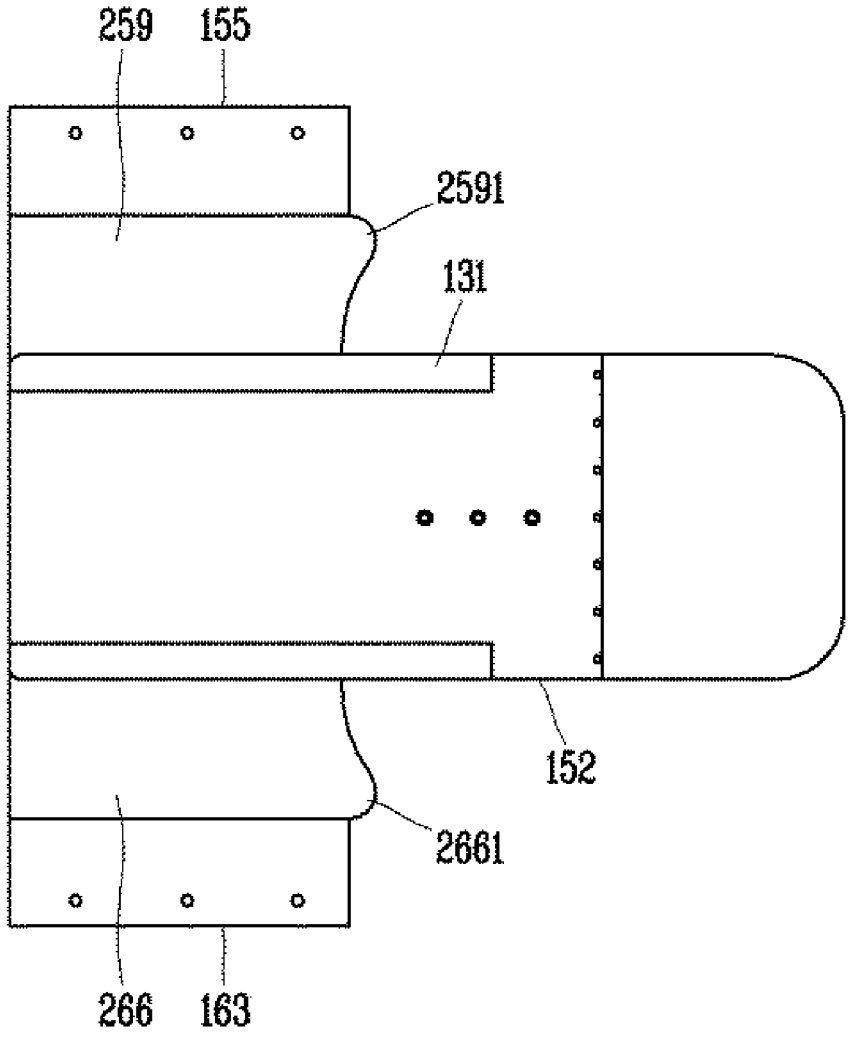
FIG. 11 is a plan view showing the state in which a plurality of sub-boards are installed to be able to transversely move on a plurality of fixed plates according to another embodiment of the present disclosure.
Figure 12:
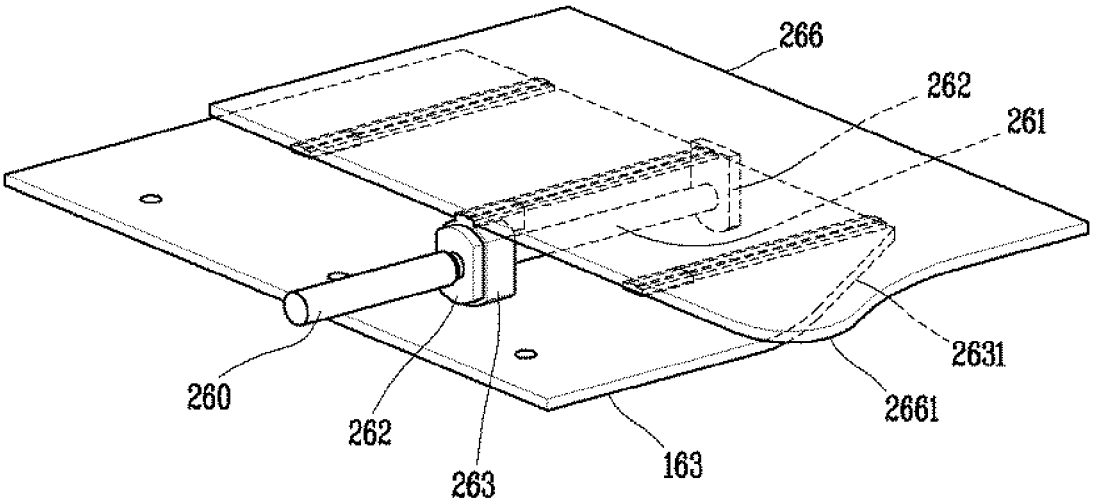
FIG. 12 is a conceptual view showing movement of the sub-boards by power transmitted through a ball screw in FIG. 11.

FIG. 11 is a plan view showing the state in which a plurality of sub-boards 259 and 266 are installed to be able to transversely move on a plurality of fixed plates 155 and 163 according to another embodiment of the present disclosure and FIG. 12 is a conceptual view showing movement of the sub-boards 259 and 266 by power transmitted through a ball screw in FIG. 11.

This embodiment is different from the embodiments described above (see FIG. 3) in that the sub-boards 259 and 266 protrude forward further than the fixed plates 155 and 163 toward the upstream side of the path of clothes or the front of the case.

However, this embodiment is the same or similar in that the fixed plates 155 and 163 and the sub-boards 259 and 266 are spaced downward apart from the main board with different height differences and are mounted to be able to transversely movable on the top surfaces of the fixed plates 155 and 163.

Other components are the same as or similar to those of the embodiments described above, so repeated configuration is omitted and differences are mainly described.

The sub-boards 159 and 166 may have protrusions 2591 and 2661, respectively. The protrusions 2591 and 2661 protrude forward from the front ends of the sub-boards 259 and 266. The front means the upstream side of the path of clothes.

The protrusions 2591 and 2661 may be formed at transversely outer sides of the sub-boards 259 and 266. The protrusions 2591 and 2661 may protrude in a curved arc shape. When seen from the front of the case, the protrusion 2591, 2661 of the first sub-board 259, 266 may be positioned at the right end of the first sub-board 259, 266 and the protrusion 2591, 2661 of the second sub-board 259, 266 may be positioned at the left end of the second sub-board 259, 266.

The left end of the first sub-board 259, 266 may be recessed rearward further than the protrusion 2591 and 2661 of the first sub-board 259, 266. The right end of the second sub-board 259, 266 may be recessed rearward further than the protrusion 2591 and 2661 of the second sub-board 259, 266.

According to this configuration, the protrusions 2591 and 2661 of the sub-boards 259 and 266 are moved close to each other in the transverse direction of the fixed plates 155 and 163 simultaneously with loading of a clothes item, the protrusions 2591 and 2661 can guide both sleeves to transversely close toward the lower portion of the main board by coming in linear contact with both sleeves and transversely pushing both sleeves.

As the clothes item is moved into the case 110, both sleeves are folded to overlap along the longitudinal lines 13 while being moved along the top surfaces of the sub-boards 259 and 266.

The fixed plates 155 and 163 each may have a chamfer portion 1631. The chamfer portion 1631 may be formed at an angle at a corner of the front end of each of the fixed plates 155 and 163.

A chamfer portion may be formed at an angle at the right side of the front end of the second fixed plate 163 positioned at the left side of the fixed plates 155 and 163. The front end of the second fixed plate 163 increases in transverse toward the rear by the chamfer portion 1631 of the second fixed plate 163.

The fixed plates 155 and 163 may be fastened to the side panels 113 of the case 110, respectively.

In this embodiment, the actuators for driving the sub-boards 260 259 and 266 may be composed of a driving motor 260, a ball screw 261, and a slider 262.

A side of the ball screw 261 is connected with the driving motor 260 and can be rotated with the driving motor 260.

Both ends of the ball screw 261 may be rotatably supported by supports 262. Bearings are installed inside the supports 262, respectively, and can rotatably support both ends of the ball screw 261. The supports 262 may be vertically installed on the fixed plates 155 and 163.

The slider 263 may be mounted to be able to slide along the ball screw 261 between the supports 262.

The sliders 263 are connected with the sub-boards 259 and 266, so when the sliders 263 are moved along the ball screws 261, the sub-boards 259 and 266 can be transversely moved over the fixed plates 155 and 163.

Figure 13:
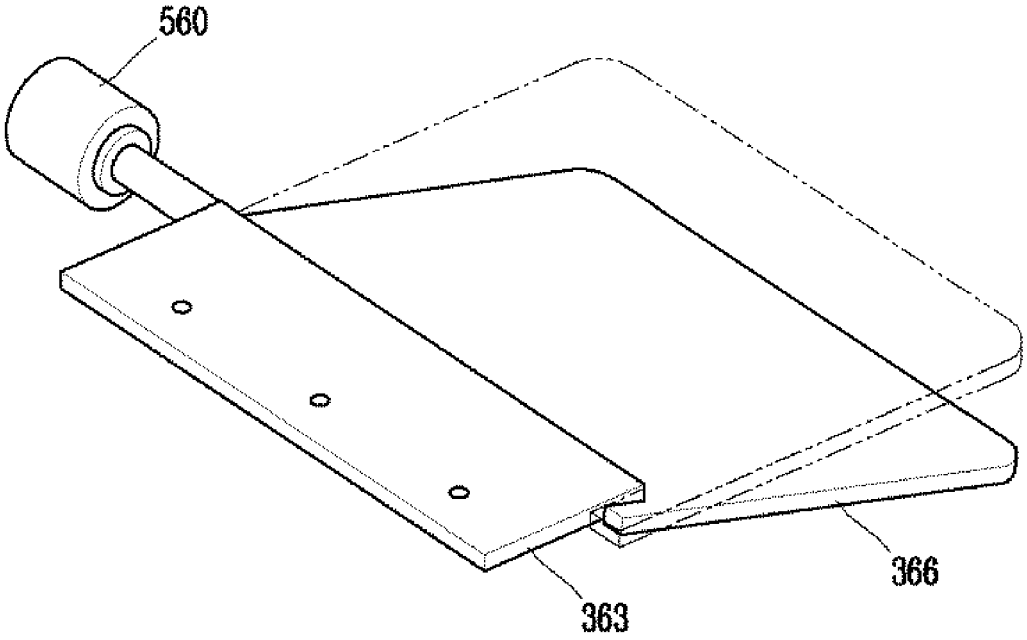
FIG. 13 is a conceptual view showing the state in which sub-boards of the present disclosure are mounted on fixed plates to be able to rotate in the up-down direction.
Figure 14:
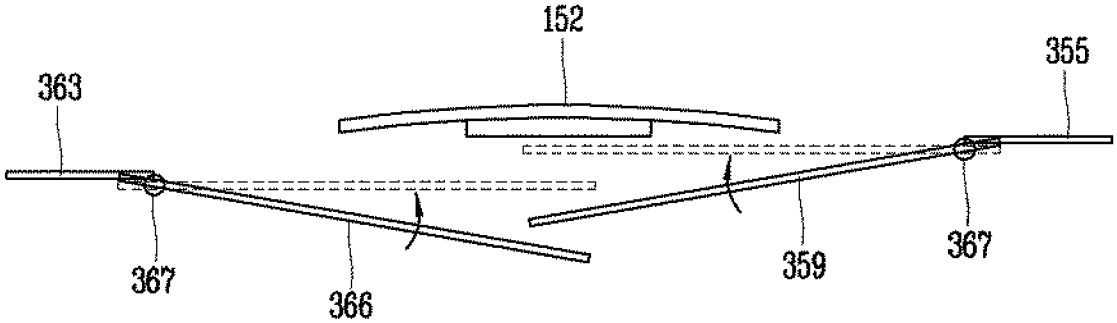
FIG. 14 is a front view showing the sub-boards shown in FIG. 13 from the front of the case.

FIG. 13 is a conceptual view showing the state in which sub-boards 359 and 366 of the present disclosure are mounted on fixed plates 355 and 363 to be able to rotate in the up-down direction and FIG. 14 is a front view showing the sub-boards 359 and 366 shown in FIG. 13 from the front of the case 110.

This embodiment is different from the embodiments described above in that the sub-boards 359 and 366 are mounted on the fixed plates 355 and 363, respectively, to be able to rotate in the up-down direction.

First sides of the sub-boards 359 and 366 are coupled to first edges of the fixed plates 355 and 363 by hinge shafts 367, respectively, and second sides of the sub-boards 359 and 366 can be rotated in the up-down direction.

Referring to FIG. 14, the right edge of the first sub-board 359 disposed at the right side of the sub-boards 359 and 366 is hinged to the left edge of the first fixed plate 355, 363 spaced apart to the right from the main board, and the left edge of the first sub-board 359 can be rotated a predetermined angle in the up-down direction.

The first sub-board 359 may be disposed to be able to rotate between the first position (initial position) and the second position (end position). The first position means that the sub-boards 359 and 366 are positioned between 1 to 90 degrees and the second position means that the sub-boards 359 and 366 are horizontally positioned.

The left edge of the second sub-board 366 disposed at the left side of the sub-boards 366 and 366 is hinged to the right edge of the second fixed plate 355, 363 spaced apart to the left from the main board, and the right edge of the second sub-board 366 can be rotated a predetermined angle in the up-down direction.

The second sub-board 366 may be disposed to be able to rotate between the first position (initial position) and the second position (end position).

The sub-boards 359 and 366 are spaced downward apart from each other at different heights with respect to the main board.

The sub-boards 359 and 366 may be disposed to partially overlap the main board in the up-down direction.

The sub-boards 359 and 366 may be installed to be able to rotate in opposite directions.

Driving motors 560 may be connected to the rear ends of the hinge shafts 367 to rotate the sub-boards 359 and 366, respectively.

According to this configuration, the sub-boards 359 and 366 are mounted at first sides of the fixed plates 355 and 363, respectively, to be able to rotate in the up-down direction, whereby they can fold both sleeves 12 of a top along the longitudinal lines 13 simultaneously with loading of the clothes item.

Figure 15:
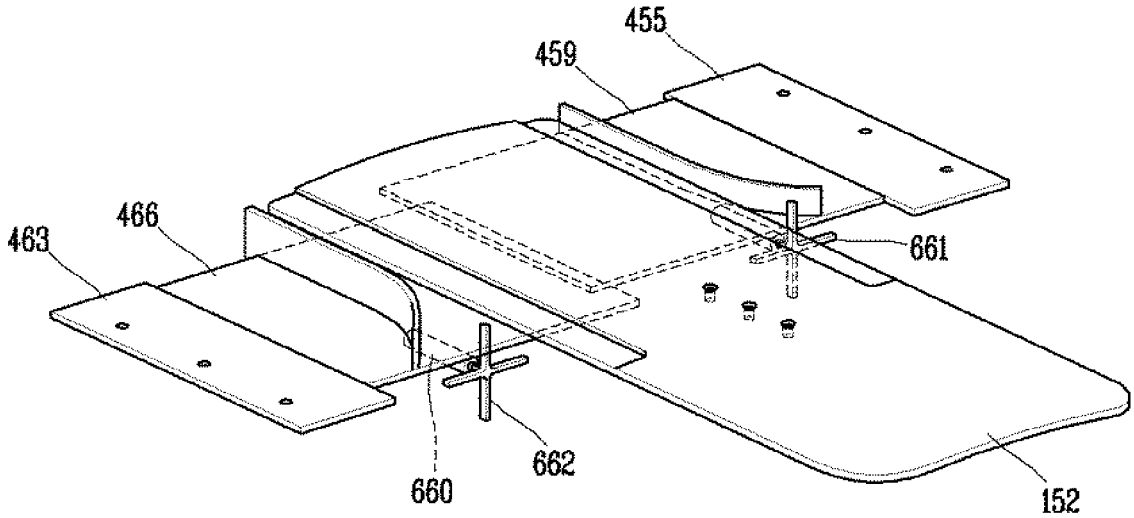
FIG. 15 is a conceptual view showing the state in which folding blades are mounted on a plurality of sub-boards of the present disclosure, respectively.
Figure 16:
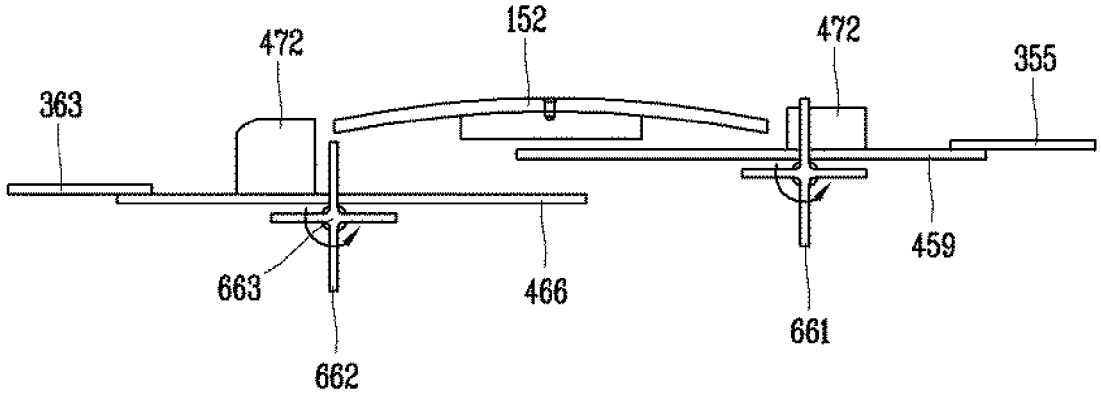
FIG. 16 is a front view showing the folding blades of FIG. 15 from the front.
Figure 17:
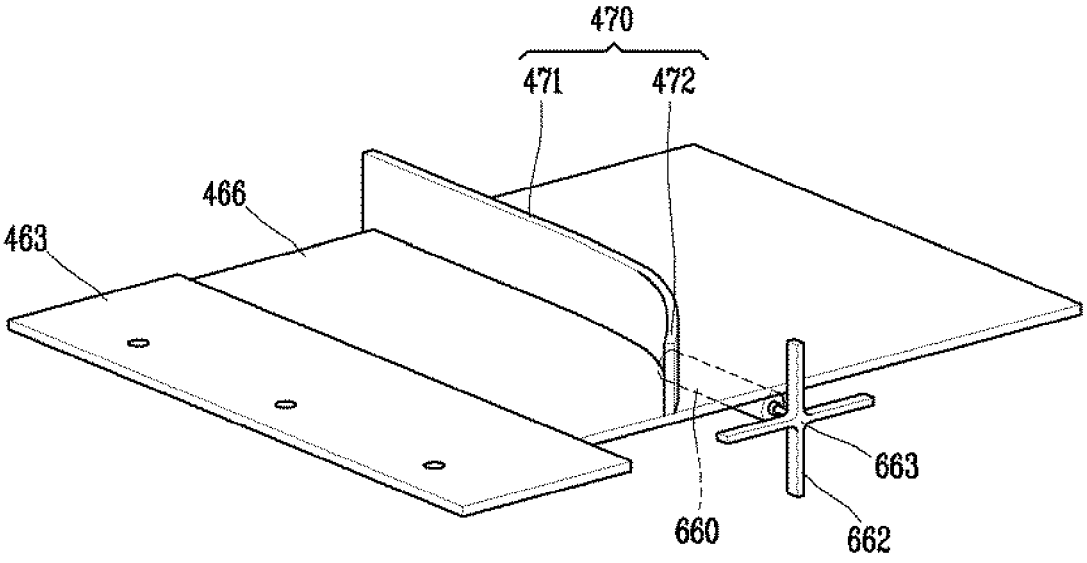
FIG. 17 is a conceptual view showing the state in which a folding blade is mounted on a second sub-board in FIG. 15.

FIG. 15 is a conceptual view showing the state in which folding blades are mounted on a plurality of sub-boards 459 and 366 of the present disclosure, respectively, FIG. 16 is a front view showing the folding blades of FIG. 15 from the front, and FIG. 17 is a conceptual view showing the state in which a folding blade is mounted on a second sub-board 466 in FIG. 15.

This embodiment is different in that rotary a folding blade 662 is mounted on each of the sub-boards 459 and 466. Other components are the same as or similar to those of the embodiments described above, so repeated configuration is omitted and differences are mainly described.

The folding blade 662 radially extends from a rotary shaft. The folding blade 662 may be formed in various types such as a rod, a bar, a thin and long rectangular strip, and a blade.

The folding blade 662 hits a clothes item that is loaded, particularly, both sleeves hanging down in the gravity direction from both side edges of the main board 152 inward in the transverse direction of the sub-boards 459 and 466 so that both sleeves are formed along longitudinal lines.

First sides of the fixed plates 455 and 463 may be horizontally installed at the side panels 113 of the case 110, respectively. The sub-boards 459 and 466 may be coupled and supported to first sides of the fixed plates 455 and 463, respectively.

The sub-boards 459 and 466 are horizontally disposed and are spaced downward apart from each other at different heights with respect to the main board 152.

The sub-boards 459 and 466 may be disposed under the main board 152 to partially overlap each other in the up-down direction.

A plurality of folding guides 470 may be installed on the top surfaces of the sub-boards 459 and 466, respectively. The folding guides 470 may be installed to vertically protrude from the top surfaces of the sub-boards 459 and 466, respectively. The folding guides 470 are configured to enable both sleeves 12 to easily approach and to maintain the folded state of the clothes item when both sleeves pass the sub-boards 459 and 466.

To this end, the folding guides 470 each may be composed of a fold maintainer 471 and an entry guide 472.

The fold maintainer 471 extends straight in the longitudinal direction of the sub-board 459 and 466 with a predetermined gap from a side edge of the main board 152, so a portion of the body part 11 and a sleeve 12 of a top can be moved between the main board 152 and the fold maintainer 471.

The fold maintainer 471 can prevent clothes passing through between the main board 152 and the fold maintainer 471 from being disheveled from the folded state. It is appropriate that the gap between the fold maintainer 471 and the main board 152 is the thickness of clothes to be able to pass clothes 10.

The entry guide 472 is disposed ahead of the fold maintainer 471 toward the upstream side of the path of the clothes item 10 and is transversely inclined toward the upstream side, so the clothes item 10 can easily approach the sub-boards 459 and 466.

The connection portion between the fold maintainer 471 and the entry guide 472 are rounded, so movement resistance of clothes can be minimized.

The folding blade 662 may protrude toward the upstream side from the sub-boards 459 and 466.

A plurality of folding blades 662 may radially extend from the center. The number of the folding blades 662 is not limited, but four folding blades 662 are formed in this embodiment. The folding blades 662 may be arranged circumferentially with regular intervals.

The folding blade 662 is rotated in the transverse direction of the main board 152 and hits the sides of a clothes item that is loaded, for example, the sleeves 12 hanging down in the gravity direction in the transverse direction of the main board 152, so both sleeves 12 are folded along the longitudinal line 13 while being seated on the sub-boards 459 and 466.

An actuator for rotating the folding blade 662 includes a driving motor 660. A plurality of folding blades 662 may be attached or coupled to a circular hub 663 to radially extend.

A rotary shaft is installed on the rear surface of the hub 663, is connected with the driving motor 660, and transmits power of the driving motor 660 to the folding blades 662.

The driving motor 660 may be mounted on the bottom surface of each of the sub-boards 459 and 466.

A conveyer for conveying clothes is disposed in the case 110.

The conveyer may be composed of an upper conveyer 121, a middle conveyer, and a lower conveyer 192.

The upper conveyer 121, the middle conveyer (corresponding to a first conveyer 178 and a second conveyer 179 in the present disclosure), and the lower conveyer 192 each may include a conveyer-driving motor, a plurality of rollers, and a belt 177. The conveyer-driving motor may be configured to rotate the conveyer belt.

The rollers are connected with the conveyer-driving motor through a shaft and can be rotated by power transmitted through the shaft. The rollers are configured to rotate the belt 177. The belt 177 surrounds and connects the rollers, thereby being able to rotate with the rollers.

The belt 177 can be rotated forward and backward by the conveyer-driving motor and clothes can be placed and conveyed on the belt 177.

The upper conveyer 121 can convey the top 10 folded along the longitudinal line to the rear of the case 110 from the longitudinal-line folder 151. The upper conveyer 121 can convey the top 10 released from the grippers 131 to the middle stage 122.

A reverse guide 167 may be formed by bending a rectangular plate having a predetermined thickness in an arc shape.

The upper end of the reverse guide 167 extend to protrude over the top surface of the upper conveyer 121 and the lower end of the reverse guide 167 may extend to the rear upper end of a push board 171, which will be described below, to deliver the top 10 onto the push board 171 of the transverse-line folder 170.

The center portion of the reverse guide 167 is curved in an arc shape, whereby the conveying direction of the top 10 that is conveyed to the rear of the case 110 can be changed.

The top surface of the top 10 (the front of the top 10 when seen from above) is turned over while being moved along the reverse guide 167 by the upper conveyer 121.

The reverse guide 167 surrounds the rear end of the upper conveyer 121 to prevent clothes from departing from the path.

Therefore, according to the present disclosure, the sub-board 159 and 166 are mounted on the fixed plates 155 and 166 to be movable in the transverse direction of the main board 152 and transversely push both sleeves 12 of the top, whereby both sleeves 12 of the top can be simultaneously folded along the longitudinal line 13 without interference.

That is, the sub-board 159 and 166 completely fold both sleeves 12 of the clothes item along the longitudinal lines 13 at a time and simultaneously by pushing the clothes item in to the space under the main board across the sides of the main board.

Unlike the related art in which the height of folding machines is increased due to folding along the longitudinal lines 13 that is performed several time at different stages, the clothes folding machine 100 of the present disclosure completes folding along the longitudinal lines 13 at one stage simultaneously with loading, the height of the clothes folding machine 100 can be considerably decreased.

Further, the first fixed plate 155 and the second fixed plate 163 are spaced downward apart from each other with different height differences with respect to the main board 152, whereby passages for both sides of the body part 11 and both sleeves 12 of the top 10 are formed. Further, both sides of the body part 11 and both sleeves 12 of the top 10 pass through the passages formed between the main board 152 and the fixed plates 155 and 163, whereby clothes are folded along the longitudinal lines 13 simultaneously with loading. Accordingly, it is possible to fold clothes along the longitudinal lines 13 while conveying the clothes minimum distance.

The first side cover 156 and the second side cover 164 protrude from the lateral ends of the first fixed plate 155 and the second fixed plate 163, respectively, and cover the gap 1790 between the sub-boards and the main board 152, whereby it is possible to prevent interference between both sleeves 12 when a clothes item passes through between the main board 152 and the first and second sub-boards 159 and 166.

Further, since a folding guide is formed at each of the first fixed plate 155 and the second fixed plate 163, both sleeves 12 are guided to be laterally folded toward the insides of the side edges of the main board 152 when a clothes item passes the main board 152 and the first and second fixed plates, whereby folding along the longitudinal line 13 is easy.

Further, since the main board 152 is curved such that the lateral center portion protrudes upward further than both side edges, there is an effect of straightening a clothes item placed on the main board 152 when the clothes item is conveyed.

Further, the conveying guides 154 recessed flat on the tops of both side edges of the main board 152 and the grippers 131 are moved in the front-rear direction while the bottom surfaces thereof maintain the minimum gap 70 from the conveying guides 154, thereby minimizing the shoulder part of a clothes item gripped by the grippers 131 and the body part 11 of the clothes item placed on the main board 152. Accordingly, it is possible to prevent the folded portions of a clothes item from being unfolded outside the longitudinal lines 13 when the clothes item folded along the longitudinal lines 13 is released from the grippers 131 and placed on the conveyer.

Figure 18:
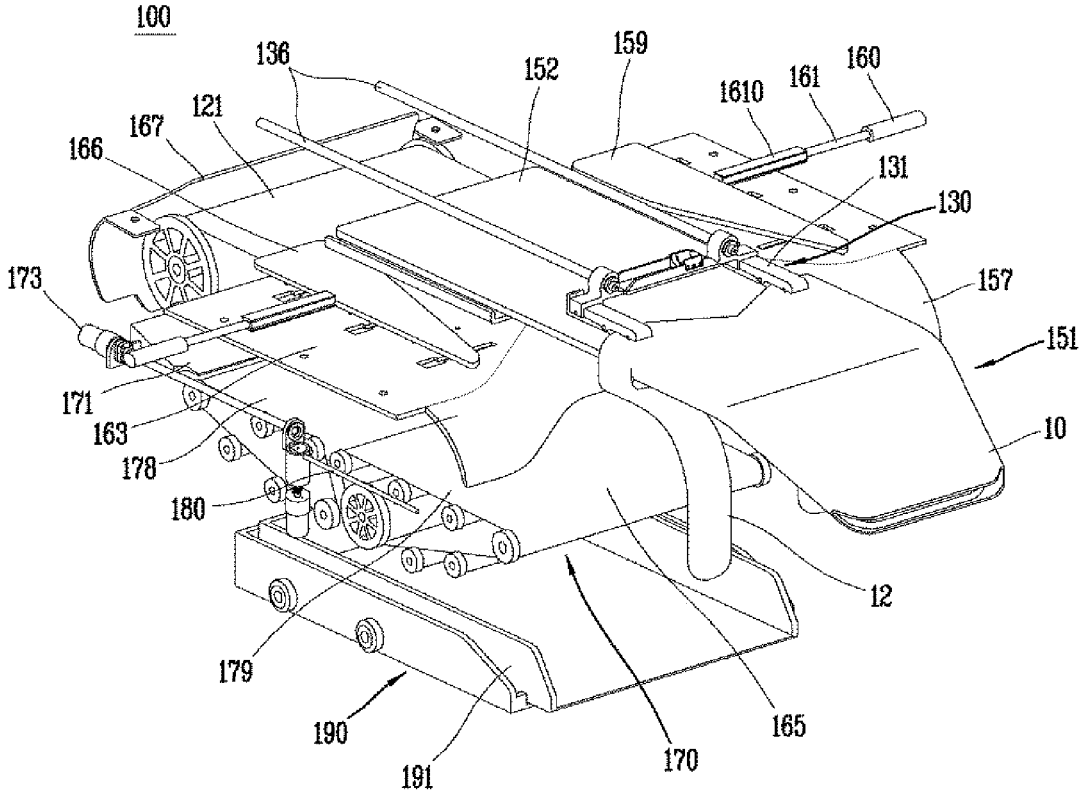
FIG. 18 is a conceptual view showing that a clothes item is loaded.
Figure 19:
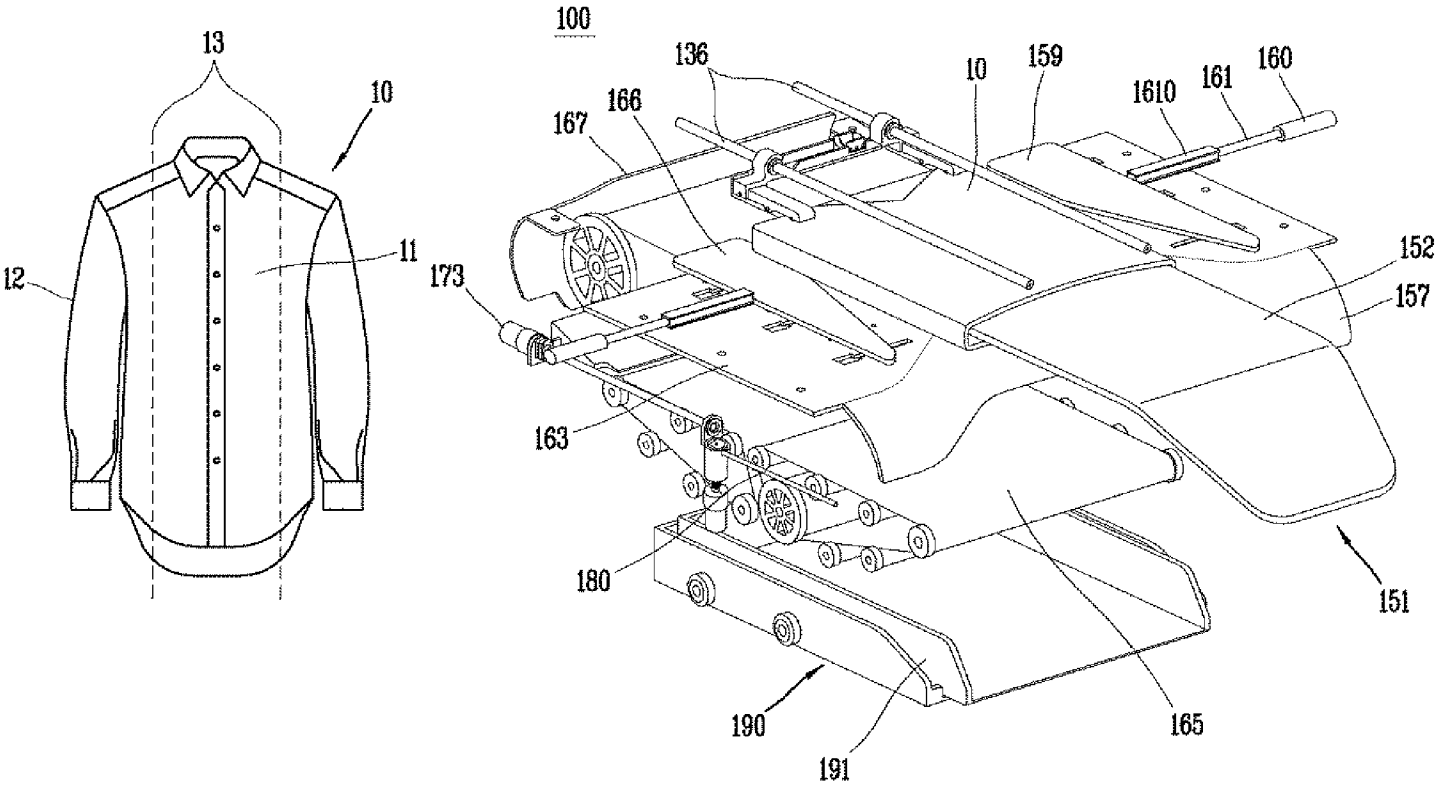
FIG. 19 is a conceptual view showing longitudinal-line folding of a clothes item.
Figure 20:
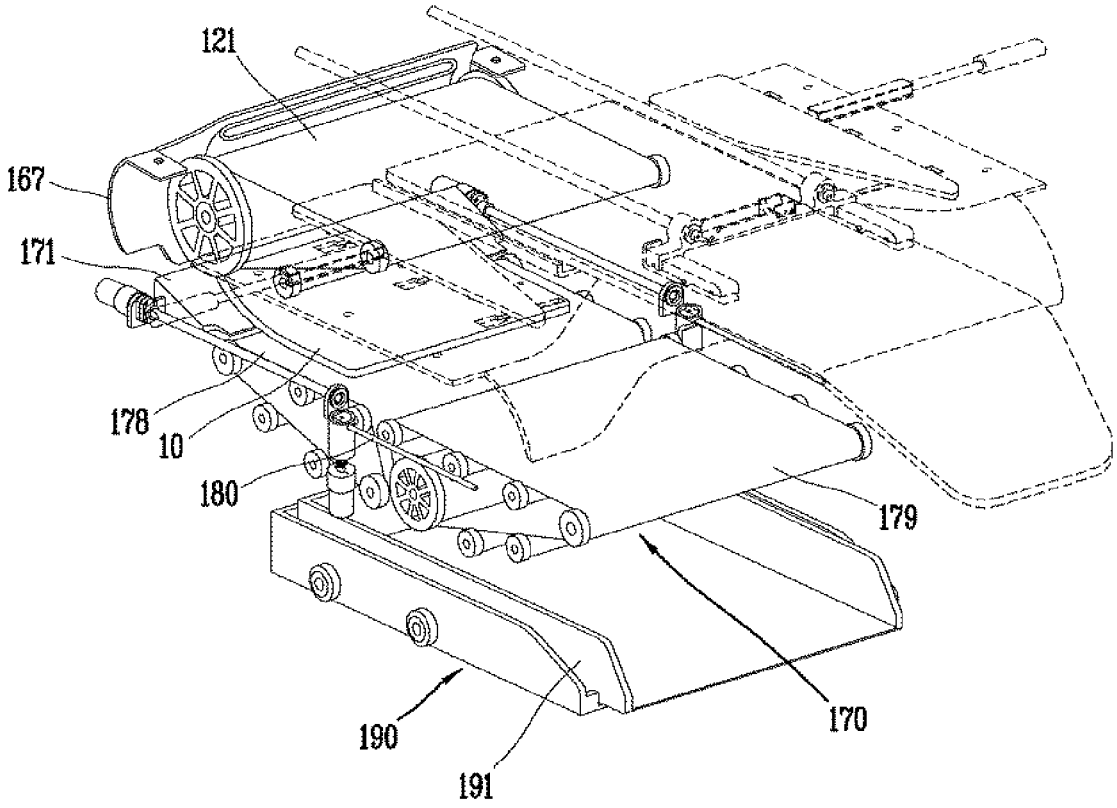
FIG. 20 is a conceptual view showing that a clothes item is conveyed to a transverse-line folder by a reverse guide.

FIG. 18 is a conceptual view showing that a clothes item is loaded, FIG. 19 is a conceptual view showing longitudinal-line folding of a clothes item, and FIG. 20 is a conceptual view showing that a clothes item is conveyed to the transverse-line folder 170 by the reverse guide 167.

Hereafter, a method of folding clothes of the present disclosure is described.

The loading unit 130 and the longitudinal-line folder 151 disposed at the upper stage can fold a top 10 along the longitudinal lines 13 simultaneously with loading of the clothes item.

The transverse-line folder 170 disposed at the middle stage 122 can complete primary transverse-line folding and secondary transverse-line folding on the top 10 folded along the longitudinal lines 13.

The unloading unit 190 disposed at the lower stage 123 can unload the top 10 folded along the longitudinal lines and the transverse lines.

In particular, longitudinal-line folding is described in more detail.

A user may hang a top 10 such that the sounder lines are gripped by the grippers 131 of the clothes folding machine 100.

The loading unit 130 conveys the top 10 gripped by the grippers 131 inward from the front of the case 110. When the top 10 is conveyed (loaded), the body part 11 is supported by the main board 152 and both sides of the body part 11 and both sleeves 12 of the top 10 hang down in the gravity direction from both side edges of the main board 152.

The longitudinal-line folder 151 folds the top along the longitudinal lines 13 simultaneously with loading of the top 10. Since the grippers 131 are moved with the bottom surfaces maintaining a minimum gap (within 2 mm) from the conveying guides 154 at both side edges of the main board 152, the height difference between the shoulder lines of the top and the both part 11 of the top 10 placed on the main board 152.

The main board 152 supports the body part 11 of the top 10 such that the body part 11 can slide from the front to the rear of the case 110. Both side edges of the main board 152 can form the longitudinal lines 13 longitudinally extending from both shoulder lines of the top 10.

Since the main board 152 is curved such that the center portion is convex further than both side edges, there is an effect of straightening the body part 11 of the top 10.

Since the fixed plates 155 and 163 are horizontally disposed at both sides of the main board 152 with different height differences with respect to the main board 152, thereby being able to form passages for both sleeves 12 hanging down from both side edges of the main board 152 in cooperation with the main board 152.

When a portion of the body part and both sleeves of the top 10 pass through the first passage formed between the main board 152 and the first fixed plate and the second passage formed between the main board and the second fixed plat, the sub-board 159 and 166 move in the transverse direction of the fixed plates and push the portion of the body part and both sleeves of the top, whereby both sleeves 12 are simultaneously folded to overlap the body part along the longitudinal lines 13.

The top 10 folded along the longitudinal lines 13 is conveyed toward the reverse guide 167 by the upper conveyer 121. The reverse guide 167 presses the upper end of the release protrusions formed at the rear ends of the grippers 131, whereby the top 10 is released from the grippers 131.

The reverse guide 167 delivers the top 10 to the first conveyer 178 of the transverse-line folder 170 that is the middle conveyer from the upper conveyer 121. While the top 10 is conveyed along the reverse guide 167, the top surface (front) and the bottom surface (back) of the top 10 are switched and the conveying direction is changed in the opposite direction.

That is, the front of the top 10 faces up on the upper conveyer 121 and then faces down on the middle conveyer (the first conveyer 178 and the second conveyer 179) after passing the reverse conveyer 167. The neck part of the top 10 is conveyed rearward from the front on the upper conveyer 121 and then conveyed forward from the rear on the middle conveyer.

The top 10 folded along the longitudinal lines 13 is conveyed from the reverse guide 167 to the transverse-line folder 170.

Those skilled in the art would understand that the technical configuration of the present disclosure may be implemented in various ways without changing the necessary features or the spirit of the prevent disclosure.

Therefore, it should be understood that the embodiment described above is not limitative, but only an example in all respects, the scope of the present disclosure is expressed by claims described below, not the detailed description, and it should be construed that all of changes and modifications achieved from the meanings and scope of claims and equivalent concept are included in the scope of the present disclosure.

The invention claimed is:

1. A clothes folding machine comprising:

a case;

a loading unit disposed at an upper portion of the case, having a plurality of grippers, and conveying a clothes item gripped by the grippers into the case;

a folding unit including a longitudinal-line folder folding both sleeves of the clothes item along longitudinal line to overlap and a transverse-line folder configured to fold the clothes item along a transverse line to overlap; and an unloading unit disposed at a lower portion of the case and conveying the clothes item folded by the folding unit outside the case, wherein the longitudinal-line folder is disposed at a same single stage together with the loading unit, wherein the longitudinal-line folder includes:

a main board supporting a body part of the clothes item conveyed by the loading unit such that the body part can slide, and a plurality of sub-boards installed to be able to transversely move with respect to the main board and folding the sleeves along the longitudinal lines, respectively, by transversely pushing the sleeves simultaneously with conveying by the loading unit, wherein the sub-boards are mounted on a plurality of fixed plates, respectively, to be able to transversely move, wherein the fixed plates are spaced apart from each other with different height differences under the main board, wherein the sub-boards are smaller in size than the fixed plates, and wherein front ends of the fixed plates protrude toward a front of the case further than front ends of the sub-boards.

2. The clothes folding machine of claim 1, wherein the sub-boards are spaced apart from each other with different height differences under the main board.

3. The clothes folding machine of claim 1, wherein the sub-boards each include:

an entry guide formed such that a width gradually increases toward a downstream side from an upstream side of a path of the clothes item; and a fold maintainer formed with a constant width from the entry guide.

4. The clothes folding machine of claim 1, wherein front guides, which are inclined downward toward the front of the case and to which the clothes item is loaded, are formed at the front ends of the fixed plates, respectively, and lift the sleeves hanging down from the main board.

5. The clothes folding machine of claim 1, wherein a plurality of guide protrusions guiding straight movement is formed on a bottom surface of each of the sub-boards, and wherein a plurality of guide grooves is formed at the fixed plates to be able to be coupled to the guide protrusions.

6. The clothes folding machine of claim 1, further comprising:

a driving motor driving each of the sub-boards such that the sub-boards can transversely straightly move;

a screw connected with the driving motor to rotate; and a sliding member connected to a side edge of each of the sub-boards, having a nut portion coupled to the screw therein, and mounted to be able to slide along the screw.

7. The clothes folding machine of claim 1, further comprising:

a driving motor driving each of the sub-boards such that the sub-boards can transversely straightly move;

a ball screw connected with the driving motor to rotate; and a slider thread-fastened to the ball screw at an inner side thereof and transversely sliding along the ball screw.

8. The clothes folding machine of claim 1, further comprising:

a driving motor driving each of the sub-boards such that the sub-boards can transversely straightly move;

a pinion gear connected with the driving motor through a shaft to rotate;

a rack gear engaged with the pinion gear and converting rotational motion of the driving motor into straight motion; and a support rotatably supporting the shaft and connected to each of the sub-boards.

9. The clothes folding machine of claim 1, wherein the sub-boards are rotatably mounted on top surfaces of the fixed plates, respectively, and are rotated between a first position where the sub-boards open in parallel toward an upstream side of a path of the clothes item and a second position where the sub-boards transversely close, and wherein the fixed plates are spaced apart from each other with different height differences under the main board.

10. The clothes folding machine of claim 9, further comprising:

a driving motor driving each of the sub-boards such that the sub-boards can be transversely rotated; and a rotary shaft of which a first side is connected with the driving motor and a second side is coupled to a corner of each of the sub-boards to rotate each of the sub-boards.

11. The clothes folding machine of claim 1, wherein the sub-boards are disposed to protrude toward an upstream side of a path of the clothes item further than the fixed plates.

12. The clothes folding machine of claim 11, wherein a protrusion is formed on a transverse outer side of each of the sub-boards, and the protrusion protrudes in a curved shape toward the upstream side of a path of the clothes item from a side of each of the sub-boards.

13. A clothes folding machine comprising:

a case;

a loading unit disposed at an upper portion of the case, having a plurality of grippers, and conveying a clothes item gripped by the grippers into the case;

a folding unit including a longitudinal-line folder folding both sleeves of the clothes item along longitudinal line to overlap and a transverse-line folder configured to fold the clothes item along a transverse line to overlap; and an unloading unit disposed at a lower portion of the case and conveying the clothes item folded by the folding unit outside the case, wherein the longitudinal-line folder is disposed at a same single stage together with the loading unit, wherein the longitudinal-line folder includes:

a main board supporting a body part of the clothes item conveyed by the loading unit such that the body part can slide, and a plurality of sub-boards spaced apart from each other in an up-down direction with different height differences with respect to the main board, installed such that a first side in a transverse direction can be rotated in the up-down direction about a second side, and simultaneously folding the sleeves along the longitudinal lines, respectively, simultaneously with conveying by the loading unit, wherein the second sides of the sub-boards are coupled to first sides of a plurality of fixed plates by hinge shafts, respectively, the first sides of the sub-boards are rotated in the up-down direction between a first position where the sub-boards are horizontally positioned and a second position where the sub-boards are inclined downward, and wherein the fixed plates are spaced apart from each other with different height differences with respect to the main board.

14. The clothes folding machine of claim 13, further comprising driving motors driving the sub-boards such that the first sides of the sub-boards can be rotated, respectively.

15. A clothes folding machine comprising:

a case;

a loading unit disposed at an upper portion of the case, having a plurality of grippers, and conveying a clothes item gripped by the grippers into the case;

a folding unit including a longitudinal-line folder folding both sleeves of the clothes item along longitudinal line to overlap and a transverse-line folder configured to fold the clothes item along a transverse line; and an unloading unit disposed at a lower portion of the case and conveying the clothes item folded by the folding unit outside the case, wherein the longitudinal-line folder is disposed at a same single stage together with the loading unit, and the longitudinal-line folder includes:

a main board supporting a body part of the clothes item conveyed by the loading unit such that the body part can slide;

a plurality of sub-boards spaced apart from each other in an up-down direction with different height differences with respect to the main board and horizontally disposed; and a plurality of folding blades mounted to be able to transversely rotate at the sub-boards, respectively, and folding the sleeves hanging down in a gravity direction from both side edges of the main board along longitudinal lengths by hitting the sleeves.

16. The clothes folding machine of claim 15, further comprising driving motors disposed on bottom surfaces of the sub-boards, respectively, and driving the folding blades such that the folding blades can be rotated, respectively.

* * * * *